US007518521B2

(12) United States Patent
Feibelman et al.

(10) Patent No.: US 7,518,521 B2
(45) **Date of Patent: *Apr. 14, 2009**

(54) ROTATING ANTI-THEFT TAG

(75) Inventors: Jeffrey A Feibelman, Providence, RI (US); Norman Thibaudeau, North Providence, RI (US); William Duarte, Seekonk, MA (US); David Miller, Norton, MA (US)

(73) Assignee: Display Technologies, Inc., Johnston, RI (US)

( * ) Notice: Subject to any disclaimer, the term of this patent is extended or adjusted under 35 U.S.C. 154(b) by 507 days.

This patent is subject to a terminal disclaimer.

(21) Appl. No.: 11/347,736

(22) Filed: Feb. 3, 2006

(65) Prior Publication Data

US 2006/0145873 A1 Jul. 6, 2006

Related U.S. Application Data

(63) Continuation-in-part of application No. 10/977,058, filed on Oct. 29, 2004, now Pat. No. 7,227,467, which is a continuation-in-part of application No. 10/853,489, filed on May 25, 2004, now Pat. No. 7,129,841, which is a continuation-in-part of application No. 10/696,483, filed on Oct. 29, 2003, now Pat. No. 6,933,847.

(51) Int. Cl.
*G08B 13/14* (2006.01)

(52) U.S. Cl. ..... 340/572.9; 340/568.2; 70/57

(58) Field of Classification Search ..... 340/568.1, 340/568.2, 568.3, 568.4, 568.7, 571, 572.1, 340/572.8, 572.9, 573.1, 573.4; 70/18, 30, 70/57

See application file for complete search history.

(56) References Cited

U.S. PATENT DOCUMENTS

| | | | | |
|---|---|---|---|---|
| 3,065,946 | A | 11/1962 | Berkow | 248/317 |
| 3,253,270 | A | 5/1966 | Downer | 340/280 |
| 3,911,534 | A | 10/1975 | Martens et al. | 24/150 R |
| 3,961,431 | A | 6/1976 | Kalenian | 40/21 R |
| 3,979,802 | A | 9/1976 | Bongartz et al. | 24/213 R |
| 4,506,415 | A | 3/1985 | Swift | 24/16 PB |
| 4,580,319 | A | 4/1986 | Paradis | 24/16 PB |

(Continued)

FOREIGN PATENT DOCUMENTS

| | | |
|---|---|---|
| FR | 2 713 379 | 6/1995 |
| WO | WO 98/40591 | 9/1998 |

OTHER PUBLICATIONS

Mainetti EAS Source Tagging Solution—Watches [retrieved on Sep. 13, 2006]. Retrieved from the Internet <URL: www.bgplastics.com>.
U.S. Appl. No. 11/787,278, filed Apr. 16, 2007.

*Primary Examiner*—Van T. Trieu
(74) *Attorney, Agent, or Firm*—BainwoodHuang

(57) ABSTRACT

An anti-theft security tag includes an engagement member and a housing for supporting an electronic article surveillance (EAS) marker. The housing includes a rotating inner core for supporting the engagement member for attachment to the article. The engagement member includes a line for connection to the article and a locking mechanism for securing the first and second ends of the line therein so that the core and the engagement member can rotate together within the housing. In one embodiment, the locking mechanism includes one or more self-crimping members which automatically secure at least one end of the line upon insertion therein. One end of the rotating core may be disposed flush with one end of the housing, so that the consumer cannot twist the line in order to remove the tag.

28 Claims, 38 Drawing Sheets

U.S. PATENT DOCUMENTS 4,588,218 A 5/1986 Guiler et al. ..... 292/307 R
4,599,767 A 7/1986 Kasai ..... 24/236
4,746,909 A 5/1988 Israel et al. ..... 340/586
4,875,647 A 10/1989 Takagi et al. ..... 248/74.3
4,962,369 A 10/1990 Close ..... 340/572
5,079,540 A 1/1992 Narlow et al. ..... 340/572
5,099,228 A 3/1992 Israel et al. ..... 340/572
5,120,097 A 6/1992 Fattori et al. ..... 292/318
5,127,137 A 7/1992 Krauss ..... 24/265 R
5,146,657 A 9/1992 Frano ..... 24/265 H
5,293,668 A 3/1994 Tibiletti ..... 24/16 PB
5,337,503 A 8/1994 Goby ..... 40/665
5,421,177 A 6/1995 Sieber et al. ..... 70/57.1
5,437,172 A 8/1995 Lamy et al. ..... 70/57.1
5,502,878 A 4/1996 Anscher ..... 24/265 H
5,513,421 A 5/1996 Wells ..... 34/16 PB
5,524,463 A 6/1996 Schnekel et al. ..... 70/57.1
5,566,428 A 10/1996 Takahashi ..... 24/265 H
5,570,080 A 10/1996 Inoue et al. ..... 340/571
5,689,237 A 11/1997 Sasagawa et al. ..... 340/568
5,717,382 A 2/1998 Cooper ..... 340/572
5,722,266 A 3/1998 Yeager et al.
5,754,108 A 5/1998 Ungarsohn ..... 340/568
5,794,464 A 8/1998 Yeager et al.
5,883,576 A 3/1999 De La Huerga ..... 340/573.1
5,903,219 A 5/1999 Chen ..... 340/574
5,945,909 A 8/1999 Kolton ..... 340/572.1
5,949,336 A 9/1999 Deschenes et al. ..... 340/572.8
5,952,927 A 9/1999 Eshman et al. ..... 340/573.4
5,969,613 A 10/1999 Yeager et al. ..... 340/572.9
5,977,877 A 11/1999 McCulloch et al. ..... 340/572.8
6,002,343 A 12/1999 Auerbach et al.
6,052,876 A 4/2000 Hogan et al. ..... 24/704.1
6,064,306 A 5/2000 Deschenes et al. ..... 340/572.8
6,078,258 A 6/2000 Auerbach et al.
6,092,401 A 7/2000 Sankey et al. ..... 70/18
6,128,932 A 10/2000 Mainetti et al. ..... 70/57.1
6,188,320 B1 2/2001 Kolton et al. ..... 340/572.9
6,226,839 B1 5/2001 Sayegh ..... 24/16 PB
6,243,005 B1 6/2001 Haimovich et al. ..... 340/427
6,255,950 B1 7/2001 Nguyen ..... 340/572.8
6,308,539 B1 10/2001 Kolton et al. ..... 70/57.1
6,311,531 B1 11/2001 Sykes ..... 70/57.1
6,326,890 B1 12/2001 Costa ..... 340/572.9
6,343,819 B1 2/2002 Shiozaki ..... 292/307 R
6,373,390 B1 4/2002 Hogan et al. ..... 340/572.8
6,374,468 B1 4/2002 Cardwell, III et al. ..... 24/597
6,389,853 B1 5/2002 Pate et al. ..... 70/18
6,408,660 B1 * 6/2002 Lai ..... 70/30
6,433,686 B1 8/2002 Feibelman ..... 340/572.8
6,446,474 B1 9/2002 Tabacchi et al. ..... 70/16
6,476,717 B1 11/2002 Gross et al. ..... 340/568.1
6,523,292 B2 2/2003 Slavik
6,535,130 B2 3/2003 Nguyen et al. ..... 340/572.9
6,567,003 B2 5/2003 Kolton et al. ..... 340/572.8
6,578,394 B2 6/2003 Yin ..... 70/58
6,584,655 B1 7/2003 Cardwell, III et al. ..... 24/597
6,624,753 B2 9/2003 Elston ..... 340/572.8
6,725,506 B1 4/2004 Anscher ..... 24/3.4
6,933,847 B2 8/2005 Feibelman ..... 340/572.1
7,183,914 B2 2/2007 Norman et al. ..... 340/568.1
2002/0154014 A1 10/2002 Elston ..... 340/572.8
2002/0158762 A1 10/2002 Nguyen et al. ..... 340/572.9
2003/0020613 A1 1/2003 Cosnard ..... 340/572.8
2003/0160697 A1 8/2003 Sedon et al. ..... 340/572.9
2004/0074265 A1 4/2004 Bruening et al. ..... 70/59
2005/0029702 A1 2/2005 Deschenes et al.
2007/0029786 A1 2/2007 Morgan
2007/0285243 A1 * 12/2007 Feibelman ..... 340/572.1

* cited by examiner

ROTATING ANTI-THEFT TAG

CROSS REFERENCES TO RELATED APPLICATIONS

This application is a continuation-in-part of U.S. Ser. No. 10/977,058 filed Oct. 29, 2004, now issued U.S. Pat. No. 7,227,467, which is a continuation-in part of U.S. Ser. No. 10/853,489 filed May 25, 2004, now issued U.S. Pat. No. 7,129,841, which is a continuation-in-part of U.S. Ser. No. 10/696,483 filed on Oct. 29, 2003 now issued U.S. Pat. No. 6,933,847. The entire contents of the above applications are explicitly incorporated herein by reference in their entirety.

TECHNICAL FIELD

The invention relates generally to an anti-theft tags and, more specifically, to an anti-theft tag including an electronic article sensor disposed within a rotating core in a housing, and including a locking mechanism disposed within the housing for securing the tag to an article.

BACKGROUND

It is well known in the art to use electronic article surveillance (EAS) sensors in order to prevent the theft of consumer products. Such electronic sensors trigger an alarm if not detached or disarmed before the product is removed from the store. For many products, electronic sensors have been very effective in deterring theft. However, such sensors can be difficult to attach to certain products, for example jewelry, fishing reels, alcohol and other products, and can often be easily removed from such items even when attached. An example of a higher price item where the difficulty of attaching electronic sensors is prevalent is watches. Often sensors cannot be attached to watch bands because they can be easily slipped off one end, and if the sensors are overly large they can limit the customer's ability to try on the watch before purchasing. Thus, electronic sensors attached to products such as watches must not only be tamper resistant in the hands of the consumer, but should also not interfere with the consumer's ability to try on the product. In addition, it is desirable to have an anti-theft tag which can be readily attached to a variety of products so that a retailer can utilize a single tag with many, different products, which can be attached in a convenient manner, and which is tamper resistant so that the EAS sensor cannot be readily removed by the consumer. A variety of tags containing EAS sensors have been developed over the past years in an attempt to address these and other issues.

One such sensor is described in U.S. Pat. No. 6,188,320 to Kolton et al. The '320 patent discloses an article identification and surveillance tag having an article engaging loop (22) which is adjustable by pulling on end member (20b) which is accessible exteriorly of the tag body. The tag (10) includes a body formed of housings (12 and 14) which are joined together during use. A tail (20) includes a first tail end (20a) which is peripherally continuous with a first end of the housing (12) which defines loop (22) exteriorly of the housing. The tail (20) extends from the loop, into and through the housing and terminates in tail end piece (20b), which is accessible exteriorly of the tag (10). Housing (12) defines and interior channel (24), the walls of which are formed with facing ratchets (26 and 28). Secured to tail (20) interiorly of housing (12) is a collar (30) of pawl member (32). The outer walls of pawl member (32) are formed with teeth (34 and 36) which engage respectively with ratchets (26 and 28). The ratchets (26 and 28) and teeth (34 and 36), engage such that the pawl member (32) is moveable only in one direction, i.e., downwardly, so that the loop can only be made smaller. The ratchets and teeth thus from a one way clutch, which precludes upward movement of pawl member (32) while providing for downward movement of the pawl. In one embodiment, the tail (52) defines a loop (53) exteriorly of the housing, the tail extending from the loop and tail parts (52a, 52b), ends of which are joined inside member (52c), and which is accessible exteriorly of tag (42).

U.S. Pat. No. 6,128,932 to Mainetti et al. discloses an anti-shoplifting device including a housing having a lower half (2) and an upper half (3), and a ferromagnetic plate (4) which is inserted into an internal cavity (5) formed by the upper and lower halves after they have been joined. A flexible and/or elastic cord (8) is supported on an edge of the lower half (2) and includes a spike (9) having flexible tongues (10), the spike (9) being insertable in an irreversible manner into opening (7) of the lower half (2) in order to form a loop which is attachable to a product.

U.S. Pat. No. 5,437,172 to Lamy et. al. discloses an anti-theft device for eyeglasses including a plate (1) having a link (7) extending therefrom. The plate includes a slot (14) for inserting the free end portion (15) of the link (7) and has fastening means for retaining the end portion (15). The fastening means includes a block (16) supported on the plate (1). The link (7) is connected to the plate (1) by inserting the link into a slot (18) until a bulged portion (17) is in abutment. After the link (7) has been looped around the bridge of the frame of a pair of eyeglasses, it is then inserted into the slot (14) to be locked therein. The link is fastened by a pin (22) which is moveable perpendicularly to the link and which projects into one of the holes (10) of the link under the action of a spring (23).

U.S. Pat. No. 6,933,847 to Feibelman discloses an anti-theft security tag (10) having an engagement member (14) with a first end (22a) and second end (22b) securable within a housing (16) for attachment to an article. The housing supports an electronic article surveillance marker (12) and may include one or more channels (21a, b) for receiving and securing at least one crimping sleeve (26b). The at least one crimping sleeve (26b) is sized to receive one end of the engagement member. A slot (33) is disposed within the housing in alignment with the at least one crimping sleeve, and is sized to receive a crimping tool (38) to crimp the sleeve and secure the engagement member within the housing and to the article.

While generally effective, criminals looking to steal articles are continually finding new ways to overcome existing anti-theft devices. Accordingly, there is continued development in the art in order to further improve anti-theft tags so as to prevent criminals from tampering with, removing and/or disabling the anti-theft devices.

SUMMARY

In accordance with the present invention, there is provided an anti-theft security tag including an engagement member for attachment to an article, and a housing for supporting an electronic article surveillance (EAS) marker, the housing including a rotating inner core for retaining the engagement member. The engagement member preferably includes a line (for example a cable, plastic or nylon line, wire or the like) for attachment to the article (for example a watch band, bottle, etc.), and a locking mechanism for securing the first and second portions, or ends of the line. The rotating core preferably includes a first end having a pair of openings for receiving respective first and second ends of the line and also supports the locking mechanism therein. In one embodiment, the locking mechanism includes one or more crimping members that are self-crimping, such that they automatically secure the line upon insertion there through. The self-crimping members may preferably include a plurality of fingers or teeth which act to automatically crimp the line upon insertion into the crimping members. The self-crimping members allow the line to be moved downward into the core, but not upward, so that the engagement loop preferably cannot be removed from the housing by a consumer. In addition, the first end of the rotating core is preferably disposed flush with one end of the housing, so that the consumer likewise cannot twist the engagement member in order to break it.

In one embodiment, the one or more crimping members may be U-shaped spring-like members. In another embodiment the crimping members may be tubular with a plurality of teeth disposed within the interior wall of the tube for crimping the engagement member. In yet another embodiment, one or more disc shaped members may be utilized having teeth disposed thereon for crimping the engagement member. In any embodiment, the engagement member is inserted within the core and terminates therein such that the ends of the engagement member cannot be tampered with and the core and engagement member rotate together. The anti-theft tags disclosed herein can be readily assembled and are tamper resistant after assembly, as described in greater detail below.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENT

Figure 1:
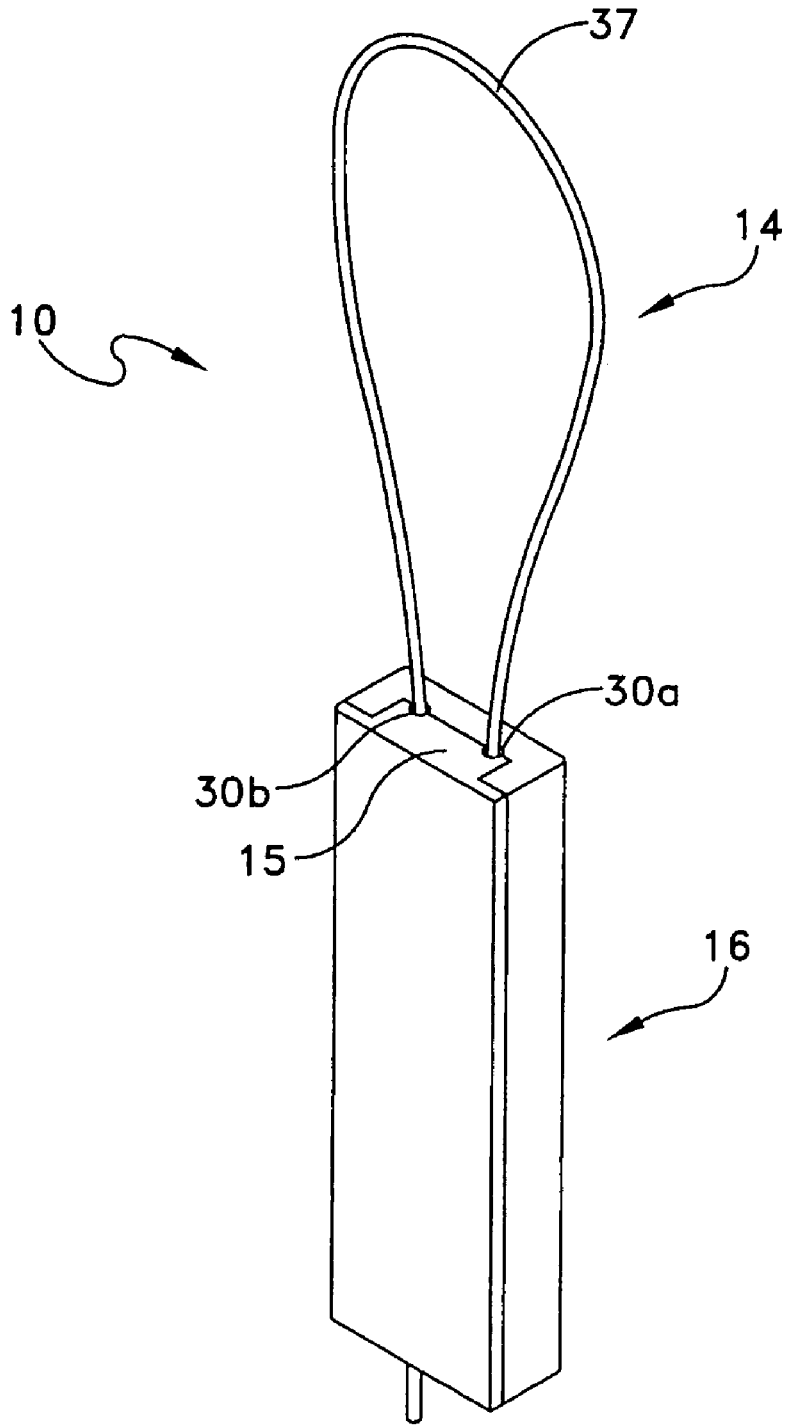
FIG. 1 is a perspective view of an anti-theft tag according to a first embodiment.
Figure 2:
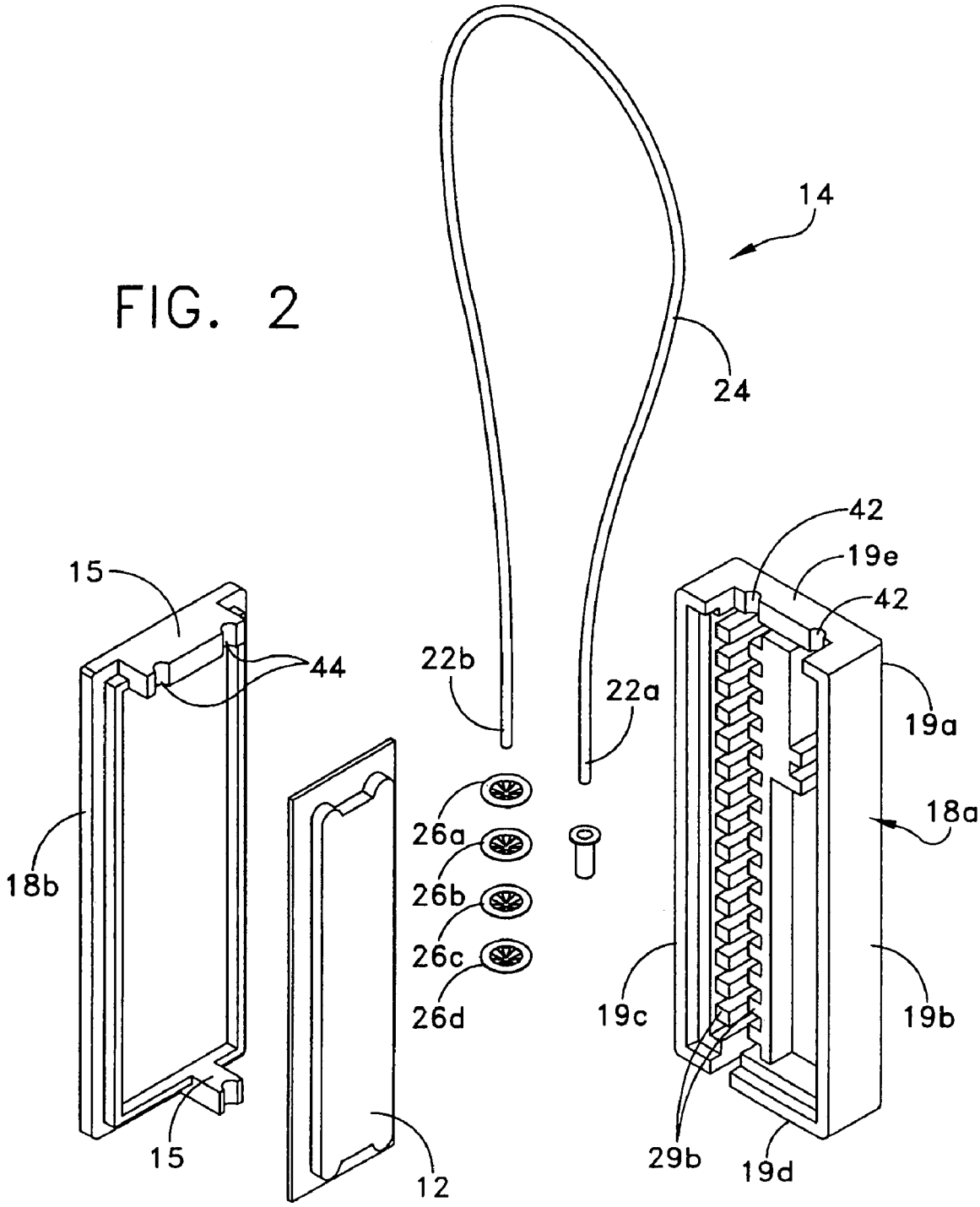
FIG. 2 is an exploded view of the anti-theft tag of FIG. 1.
Figure 3:
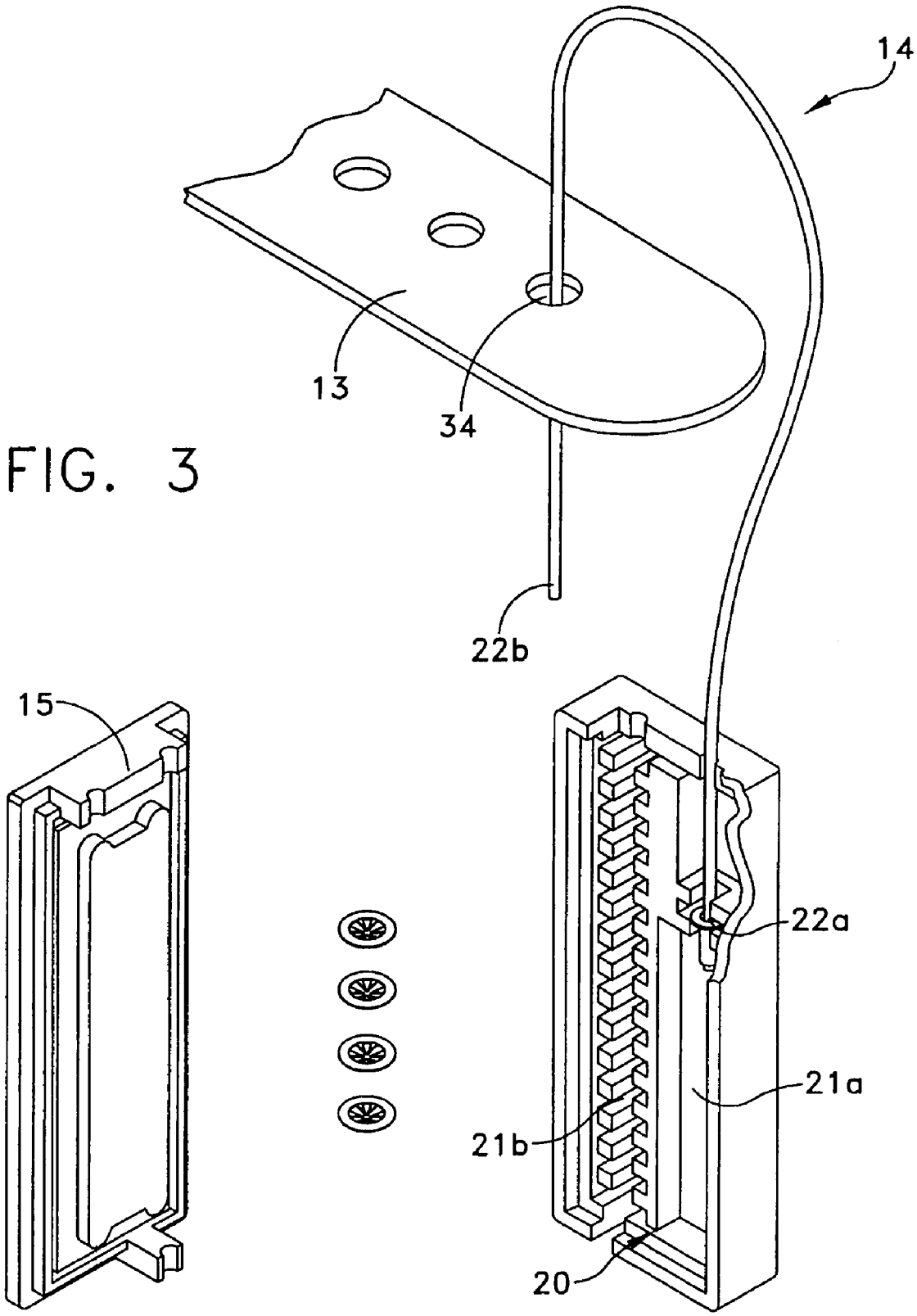
FIG. 3 is a perspective view of the anti-theft tag of FIG. 1 with the housing cover separated from the housing body.
Figure 4:
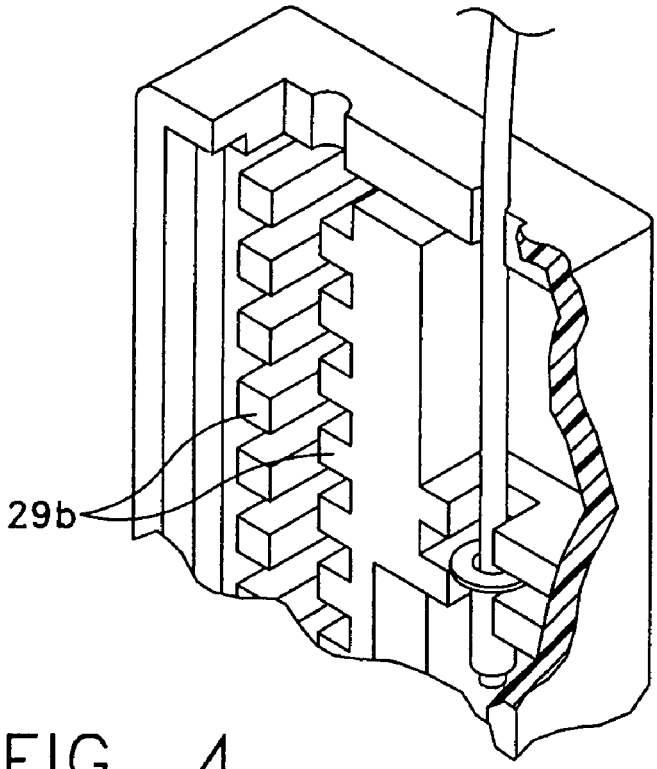
FIG. 4 is an enlarged perspective view of the top section of the housing body of FIG. 3.
Figure 5:
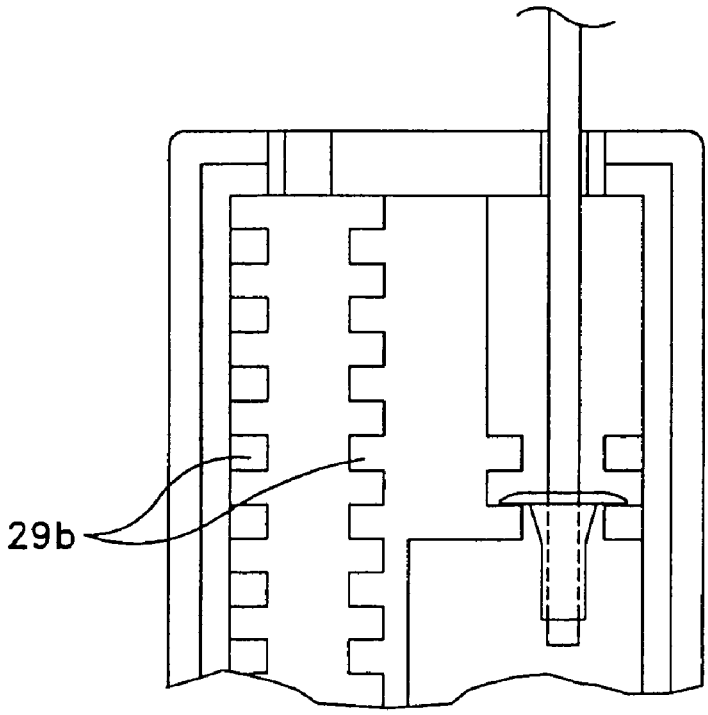
FIG. 5 is a front view of the anti-theft tag of FIG. 4.
Figure 6:
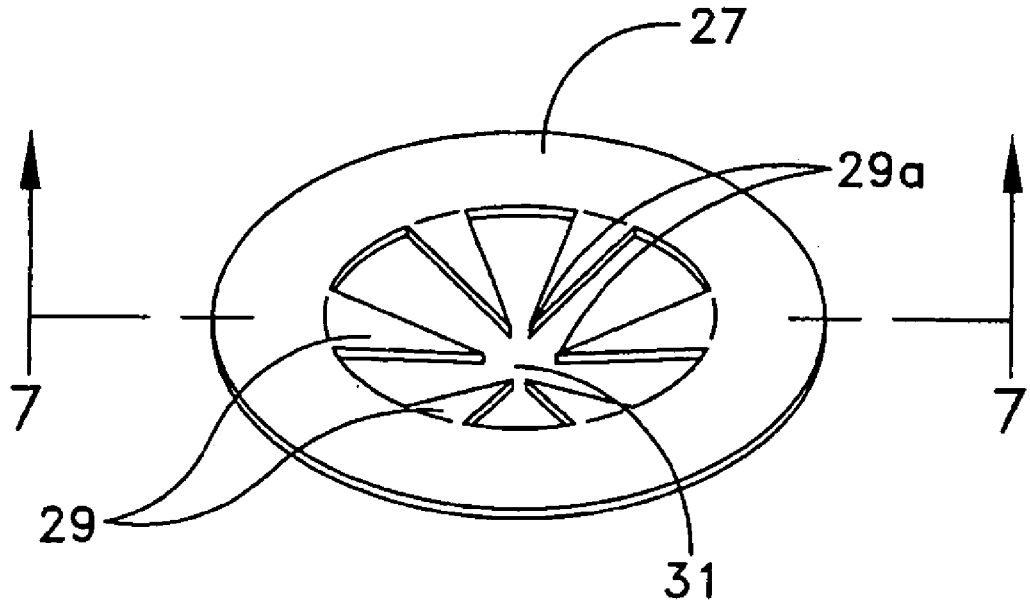
FIG. 6 is a perspective view of an exemplary single crimping member.
Figure 7:
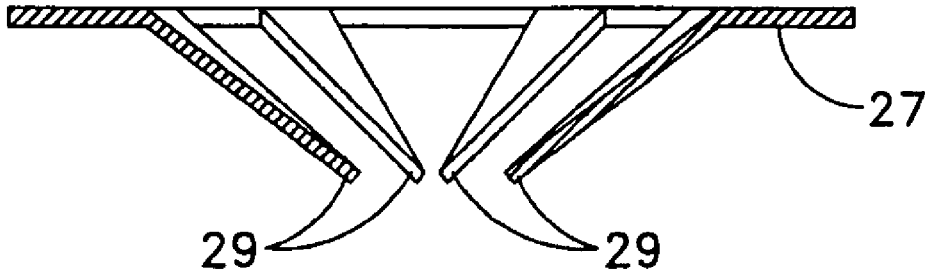
FIG. 7 is a cross-sectional view of the crimping member of FIG. 6 taken along line 7-7.
Figure 8:
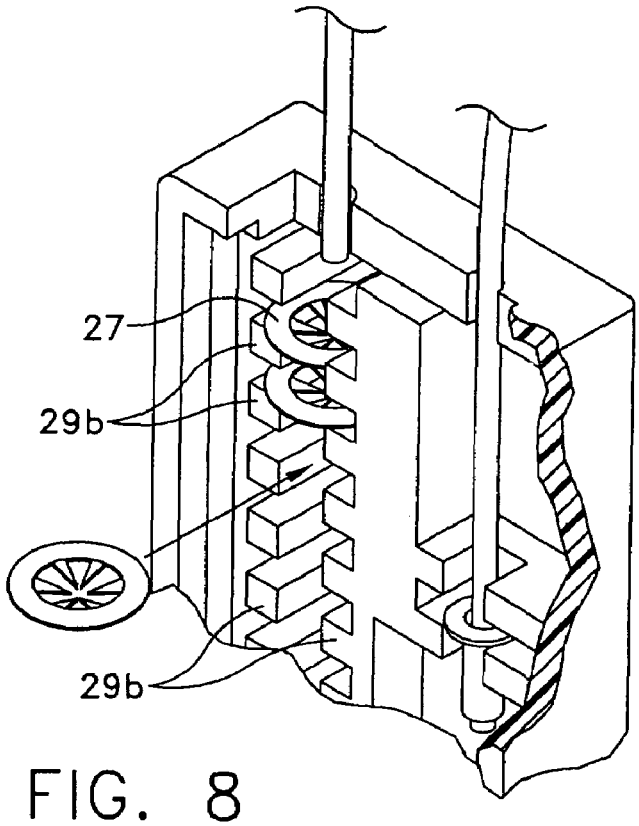
FIG. 8 is an enlarged perspective view of the top section of the housing body of FIG. 3 showing insertion of the crimping members of FIG. 6.

A first embodiment of an anti-theft security tag 10 including an electronic article surveillance marker 12 for attachment to an article, such as a watch band 13, bottle 15, or other article is illustrated in FIGS. 1-23. As used herein, the term "article" refers to any type or style of consumer product. Also as used herein, the term "crimp" or "crimped" is used in a conventional manner to mean pressing, squeezing, pinching, biting or the like into the member to be secured. Finally, as used herein, "watch" refers to any style or type of watch which may be worn by a user. However, it is expressly understood that the present invention is not limited to use with watches, or bottles, and may be used with any of a variety of articles as would be known to those of skill in the art.

The tag 10 of the present embodiment includes an engagement member 14 for securing the tag to the article, and a housing 16. Disposed within the housing is an internal crimping member 26 which, in the present embodiment is a self-crimping member as described in greater detail below. The housing also supports an electronic article surveillance (EAS) marker 12. In the present embodiment, the housing 16 preferably includes a base 18*a* and a cover 18*b*. The base may have a front wall 19*a*, side walls 19*b* and 19*c*, a bottom wall 19*d* and a top wall 19*e*, the walls bounding an interior cavity 20 of the base. The top wall 19*e* may include a pair of indents 42 which, when the base 18*a* is engaged with the cover 18*b* mate with corresponding indents 44 to form a pair of openings 30*a*, 30*b* sized to receive a first end 22*a* and a free second end 22*b*, respectively, of the engagement member 14. The openings 30*a*, 30*b* preferably provide access to a pair of channels 21*a*, 21*b* disposed within the housing. The cover 18*b* is sized to fit over the base 18*a* and is secured there to during use. In the present embodiment, the cover 18*b* includes tabs 15 which are sized to fit within corresponding openings formed in the base. The base 18*a* and the cover 18*b* also preferably form an exit opening 23 when secured together in the present embodiment. EAS marker 12 may be supported within the housing, for example, on an inner surface of the cover 18*b*, such that it is hidden within housing 16 once assembled. Alternatively, other types of housings may be utilized, as would be known to those of skill in the art.

Figure 18:
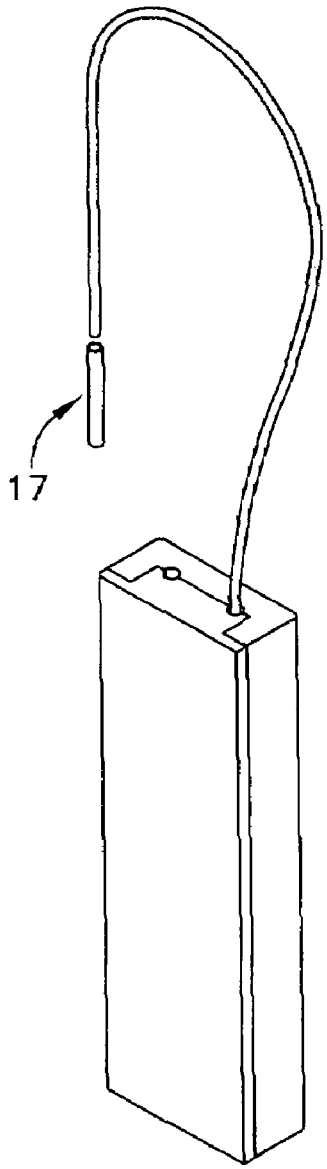
FIG. 18 is a perspective view of the housing of FIG. 1 showing an end cap supported on the insertion end of the line.
Figure 19:
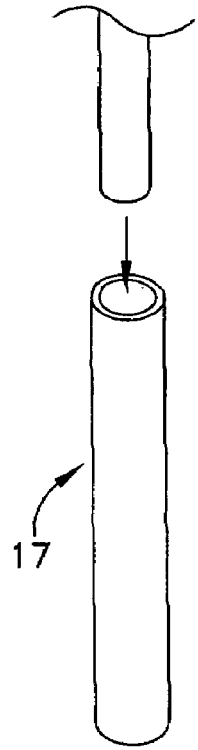
FIG. 19 is a perspective view of the end cap of FIG. 18 showing insertion of the second end of the line.
Figure 20:
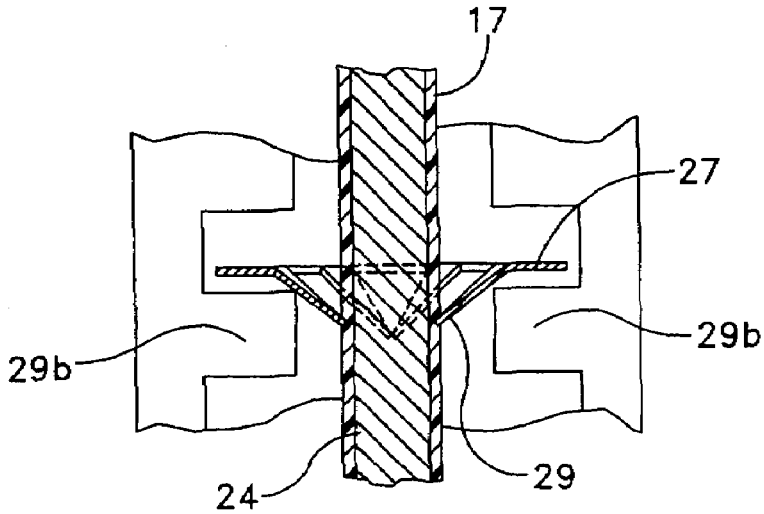
FIG. 20 is a partial cross sectional view of the end cap, line and crimping member, showing the crimping member crimping the end cap.

The engagement member 14 may take any of a variety of forms, suitable for engagement with an article, and preferably includes a line 24, and one or more crimping members 26*a-d* for retaining the free portion, or second end 22*b* of the line within the housing during use, as described in greater detail below. The line may preferably be made of wire (coated or non-coated), nylon or other semi-rigid monofilament lines, or other plastic member which is sufficiently strong so as to withstand tampering. In the present embodiment, the line is able to withstand about 40 to about 50 lbs of pressure before beginning to fail, although lines being able to withstand any of a variety of pressures may be utilized, as desired for the particular application. In the present embodiment, the line has a generally continuous outer surface which is crimped when inserted into the crimping members 26*a*-26*d*. Alternatively, a reinforcing member or end cap 17 may be secured to all or part of the line, as shown in FIGS. 18-20, and described in greater detail below.

In the present embodiment, the crimping member is internally disposed within the housing and is preferably self-crimping such that it automatically engages and crimps the line upon insertion of the line within the crimping member, without additional manual crimping. In this manner, the line is prevented from being withdrawn as soon as it engages the crimping member. The crimping member may take any of a variety of forms, provided that it engages the line so as to crimp it to deter removal of the line from engagement with the crimping member. In the present embodiment, a plurality of washer or disc shaped crimping members 26*a*-26*d* are illustrated. Each crimping member preferably includes an annular ring 27 and a plurality of inwardly extending teeth or fingers 29 (FIGS. 6-7) which crimp the line upon engagement and which may preferably flex during insertion of the line as described in greater detail below. The discs preferably operate to automatically crimp the second end of the line 22*b* when it is inserted within each of the discs. In this manner, a separate crimping step is avoided.

Figure 9:
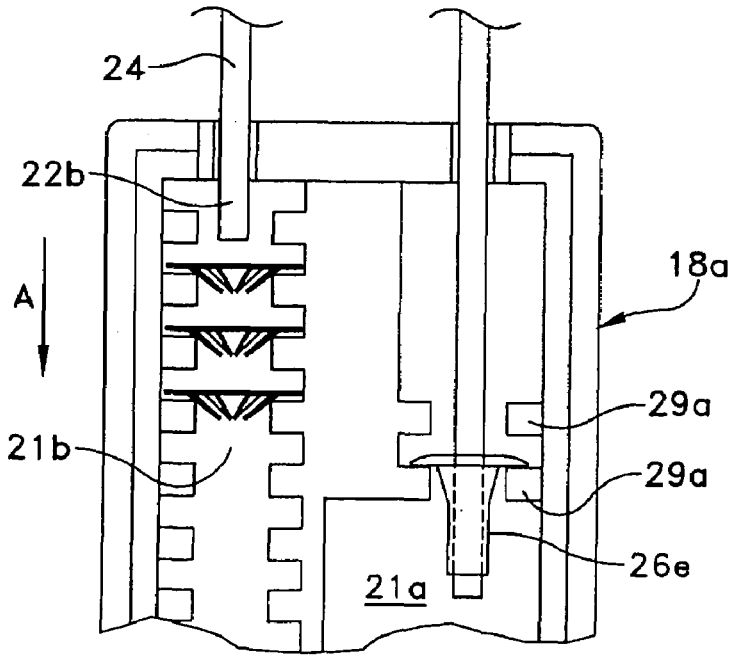
FIG. 9 is a front view of FIG. 8 showing insertion of the free end of a line into the crimping channel.

In the present embodiment, the teeth or fingers 29 may each have a generally triangular shape with pointed end 29*a* to engage and crimp the line, although other shapes may be utilized as would be known to those of skill in the art. The crimping members 26*a*-26*d* are each preferably supported within the channel 21*b* so that they are stationary longitudinally within the channel. For example, the crimping members may be supported within the channel by a plurality of shelves, or ledges 29*b*, as best shown in FIG. 9, such that they are free to rotate within the shelves or ledges, but remain positioned at a predetermined longitudinal distance within the channel. The crimping members are preferably supported in alignment with each other, but may be selectively positioned along the length of the channel, as desired. For example, although the crimping members are illustrated as being supported on successive ledges, empty ledges may be disposed between the crimping members. Also, the crimping members can be supported anywhere along the length of the channel, at the top, bottom or mid section, or a combination there of. Alternatively, the crimping members may be otherwise supported within the channel, as would be known to those of skill in the art.

Figure 10:
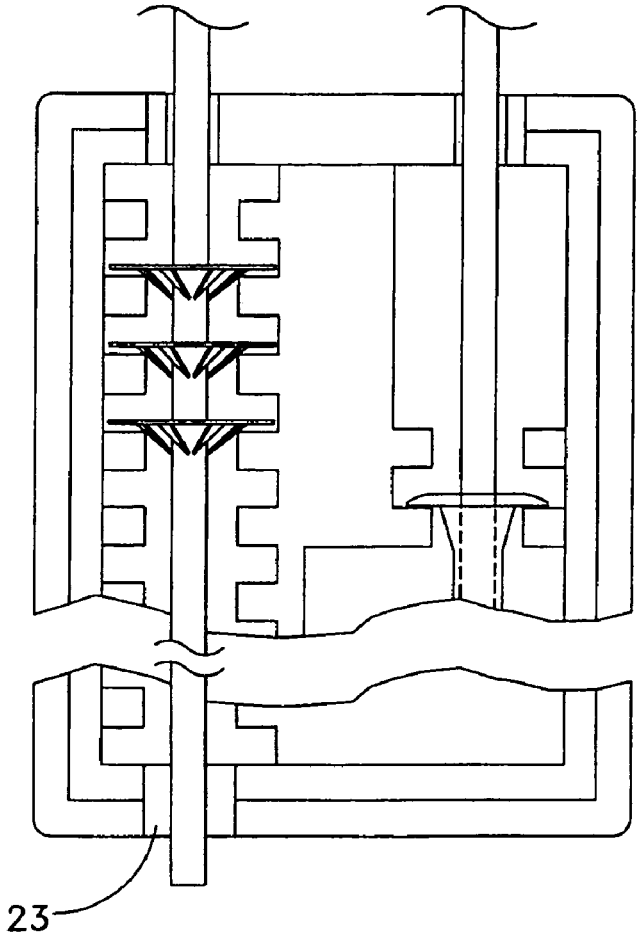
FIG. 10 is a front view of FIG. 8 showing insertion of the free end of the line into the crimping members.
Figure 11:
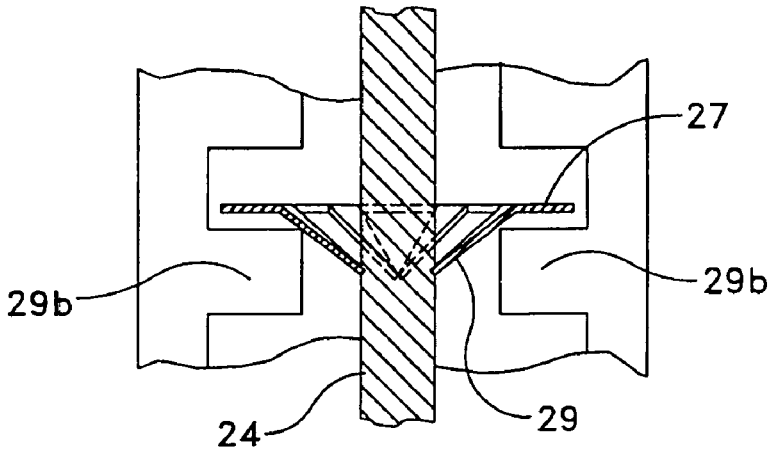
FIG. 11 is an enlarged view of FIG. 10 showing insertion of the line into a single crimping member.

In addition to being aligned with each other, the centers 31 of the crimping members are aligned with the opening 30*b* into the channel 21*b*. In this manner, upon insertion of the free insertion portion, or second end 22*b* into the center 31 of the crimping member in the direction of arrow "A" (FIG. 9) the flexible fingers 29 engage and crimp the line 24 (FIG. 10). By crimping the line the fingers prevent the line from being moved in a direction opposite arrow "A". The first end 22*a* is also secured within the housing, for example within channel 21*a*. In the present embodiment, a sleeve 26*e* is supported on ledge 29*a* and is used to secure the first end 22*a* within channel 21*a*. It is preferred that the first end be secured within the housing so that it may not be tampered with by a consumer. Alternatively, the first end may be otherwise supported on or within the housing, as would be known to those of skill in the art. Although four, disc shaped crimping members are shown, any number and shape crimping members may be utilized, as desired.

Figure 12:
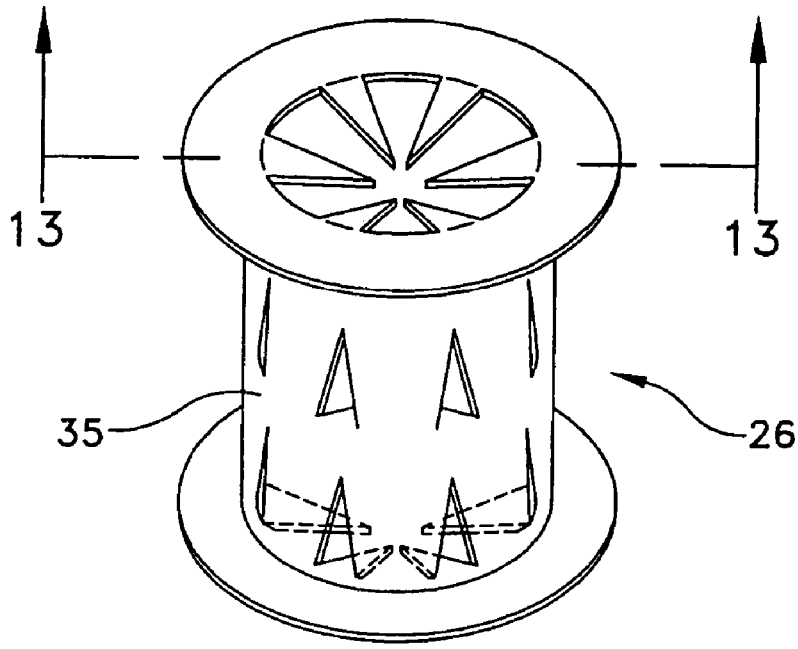
FIG. 12 is a perspective view of an alternate crimping member.
Figure 13:
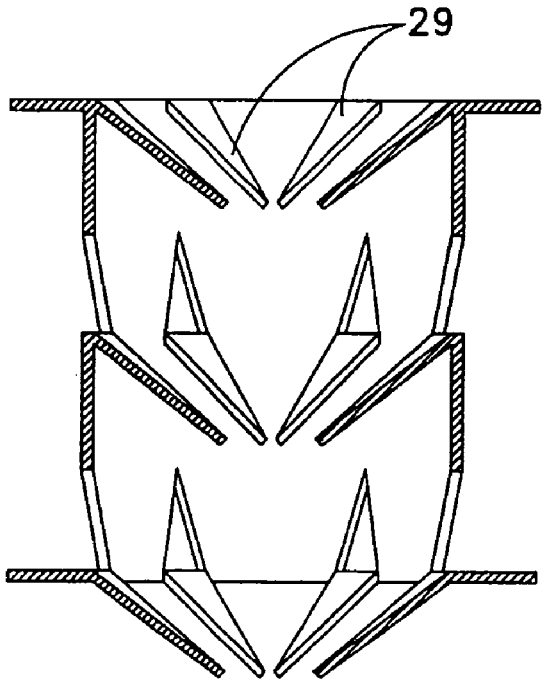
FIG. 13 is a cross-sectional view of the crimping member of FIG. 12 taken along line 13-13.
Figure 14:
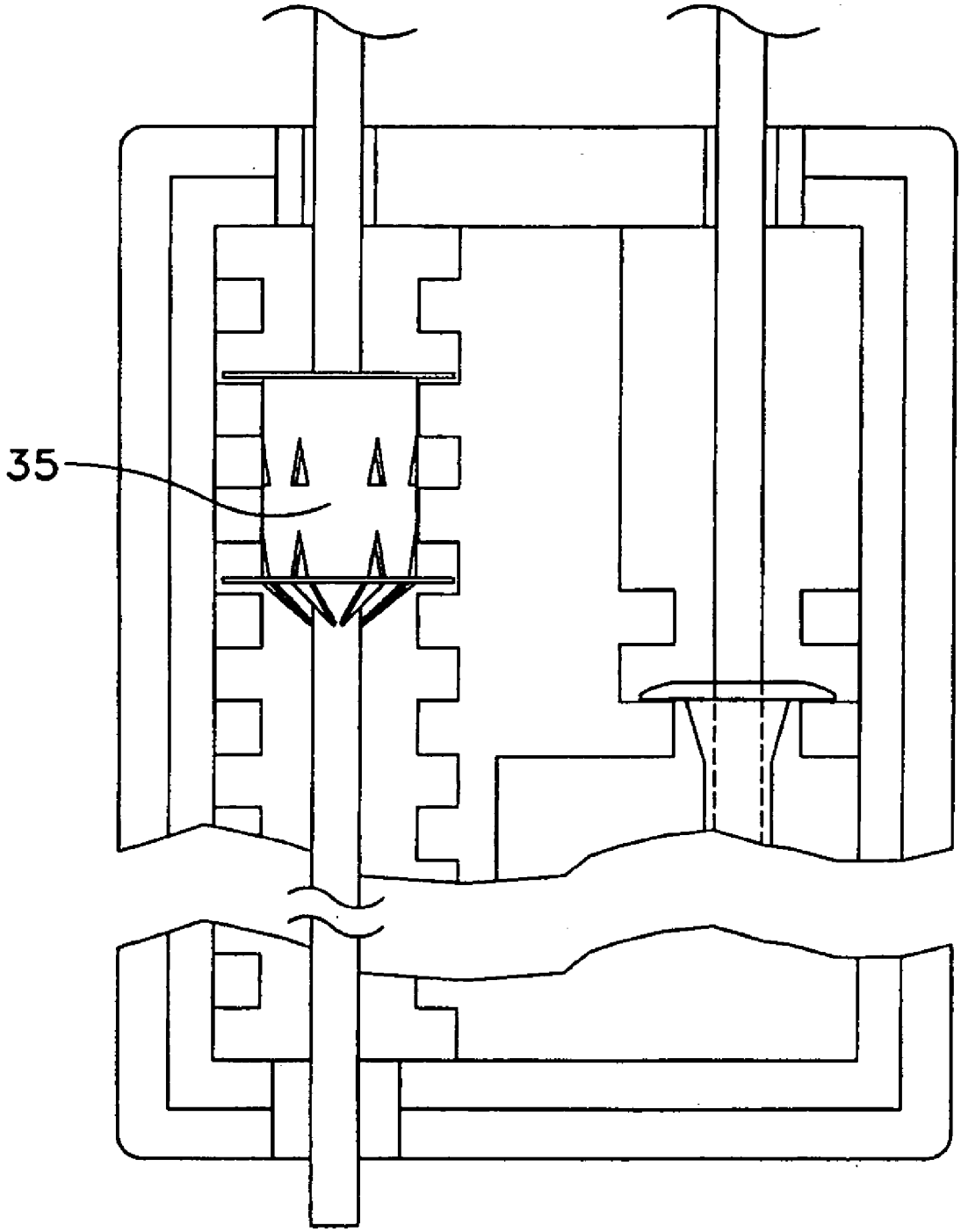
FIG. 14 is a front view with cover removed of the housing of FIG. 1, showing insertion of the free end of the line into the crimping member of FIG. 12.
Figure 15:
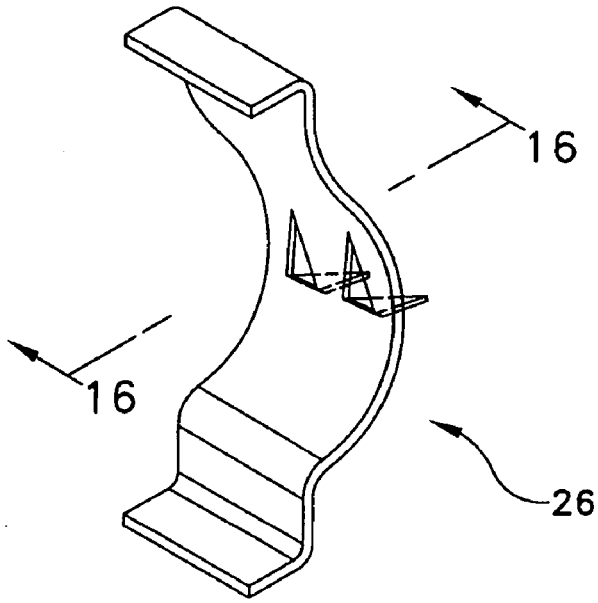
FIG. 15 is a perspective view of another alternate crimping member.
Figure 16:
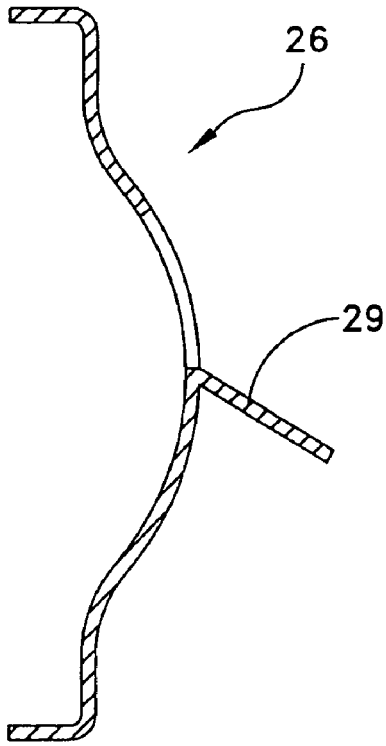
FIG. 16 is a cross-sectional view of the crimping member of FIG. 15 taken along line 16-16.
Figure 17:
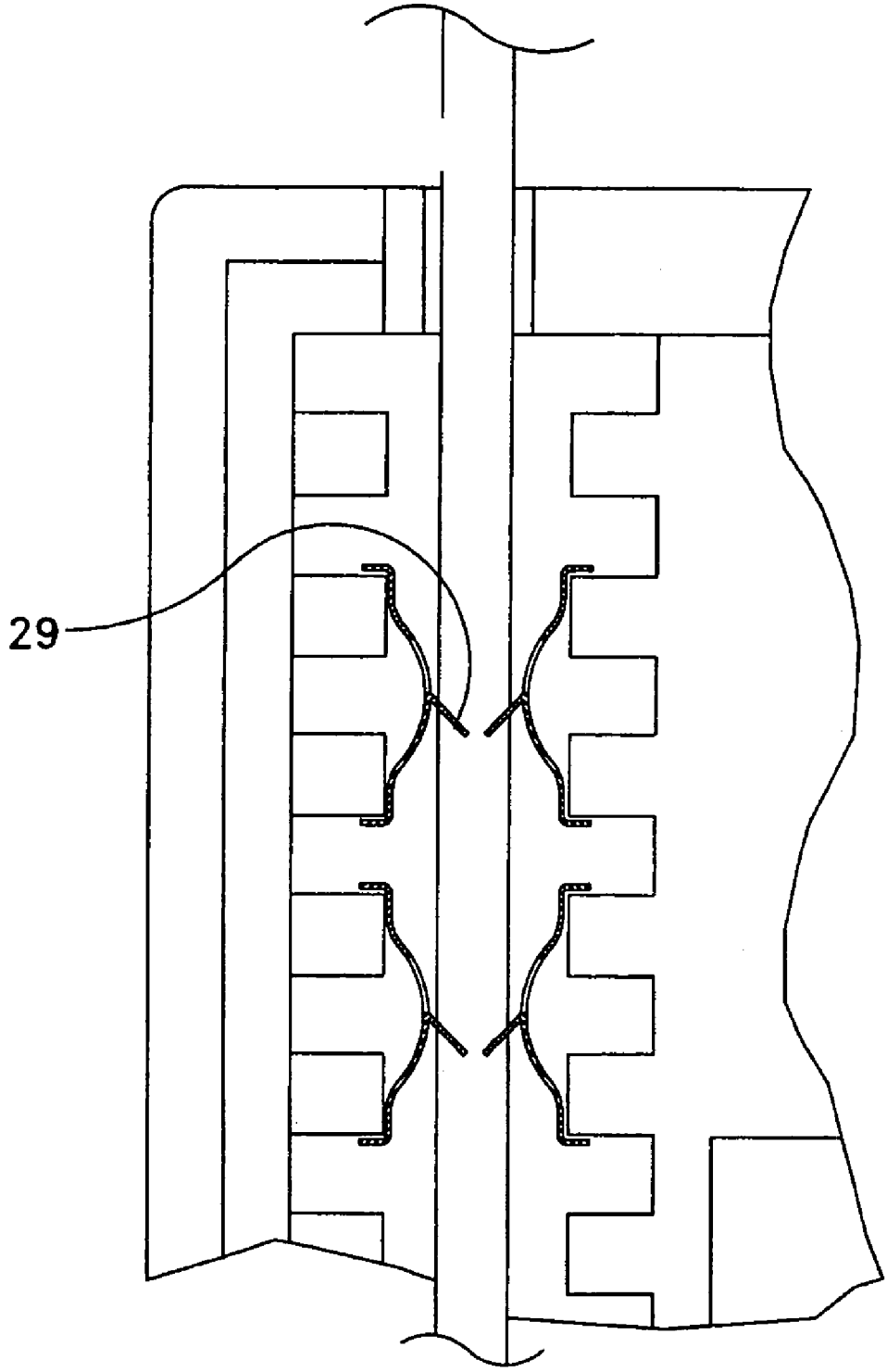
FIG. 17 is a front view with cover removed of the housing of FIG. 1, showing insertion of the free end of the engagement member into the crimping member of FIG. 15.

Referring not to FIGS. 12-17 exemplary alternate embodiments of the internally disposed crimping members are illustrated. FIGS. 12-14 illustrate a cylindrical or tubular crimping member 26, having a plurality of inwardly extending teeth or fingers 29, which operate in the same manner as discussed above with respect to the discs. The fingers 29 may be supported on annular ring 27, or within the body 35 of the tubular member, or both. FIGS. 15-17 illustrate leaf spring shaped crimping members 26. In this embodiment, instead of a round crimping member having an aperture bounded by an annular ring, a pair of springs each including at least one crimping tooth or finger 29, are spaced opposite each within the body of the housing. In this manner, as the line is inserted within the space or channel, the crimping teeth 29 again crimp the line in the manner discussed above with respect to the crimping discs and cylinder. Although shown as being supported by ledges 29*b*, alternate methods of supporting the crimping members may be utilized, as would be known to those of skill in the art. As shown in FIGS. 18-20 a reinforcing member or end cap 17 may be secured to all or part of the line, regardless of the type of crimping member utilized. In such a case, the end cap is considered to be part of the line, even if it is not a unitary member. As such, when the end cap is inserted within the line and crimped (FIG. 20), because it is secured to the line, the line likewise be prevented from removal from the crimping member. As will be appreciated, other types of crimping members may be utilized, provided that they crimp the line in order to prevent the line from being removed from the housing.

Figure 21:
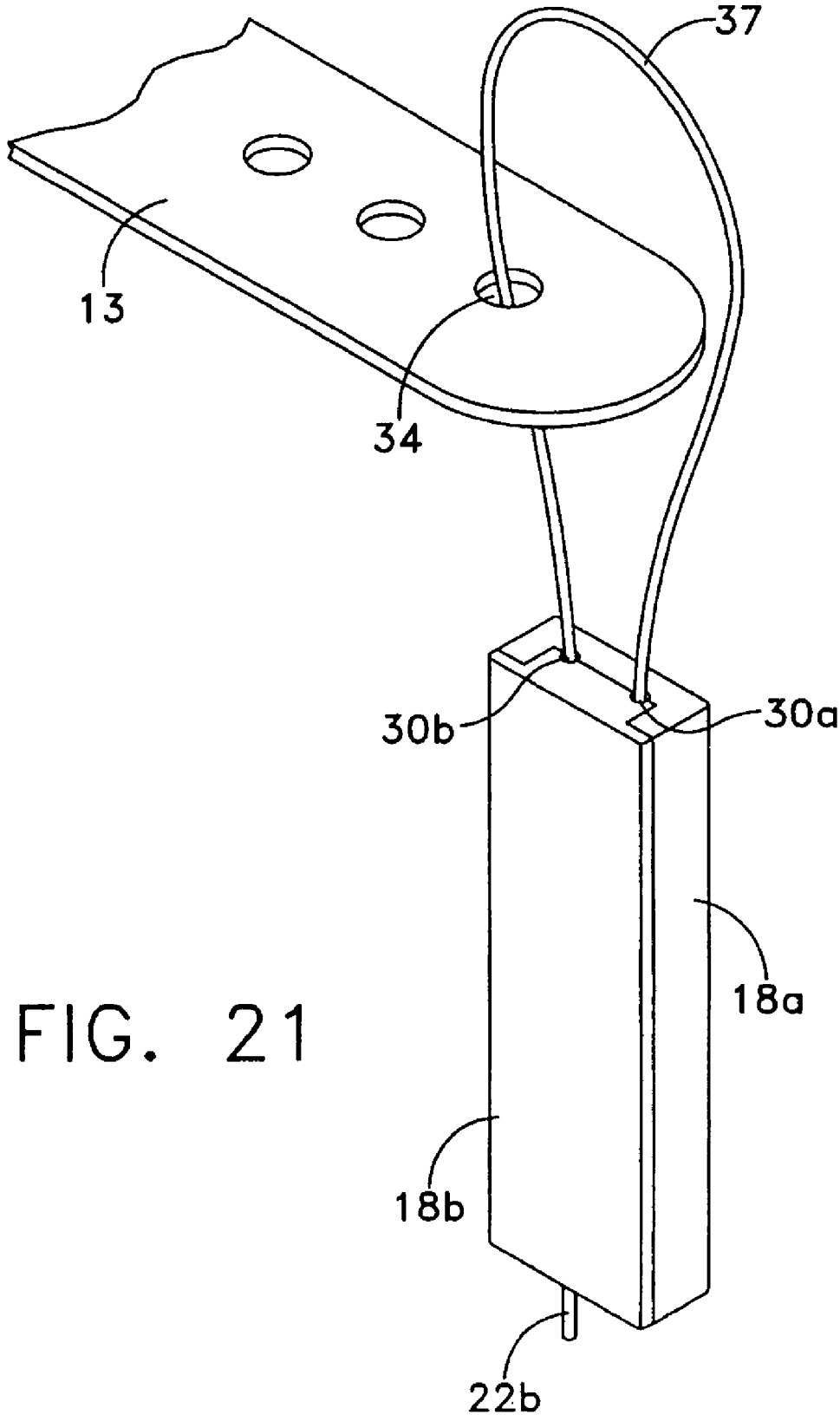
FIG. 21 is a perspective view showing attachment of the anti-theft tag of FIG. 1 to a watch band.
Figure 22:
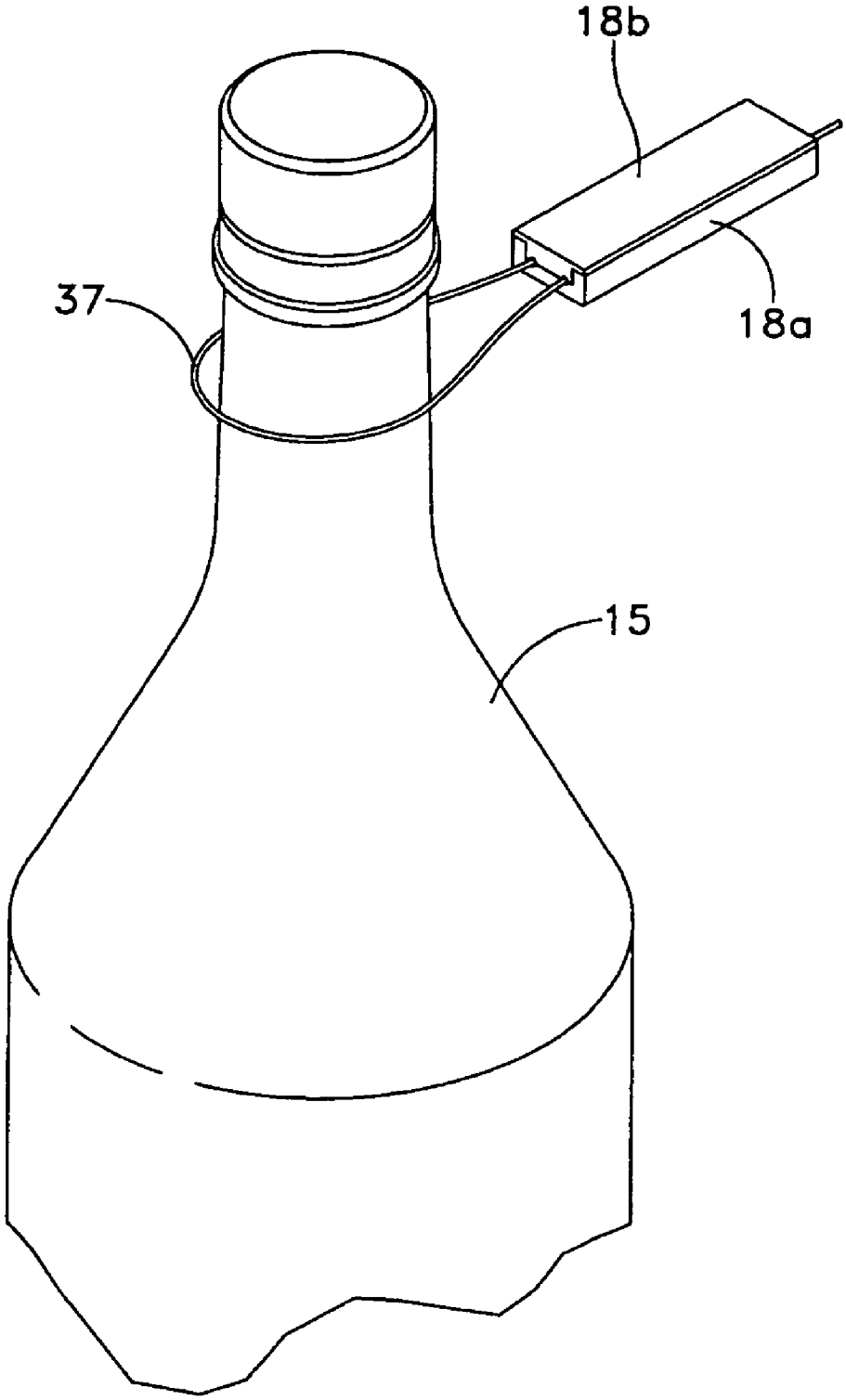
FIG. 22 is a perspective view showing attachment of the anti-theft tag of FIG. 1 to a bottle neck.
Figure 23:
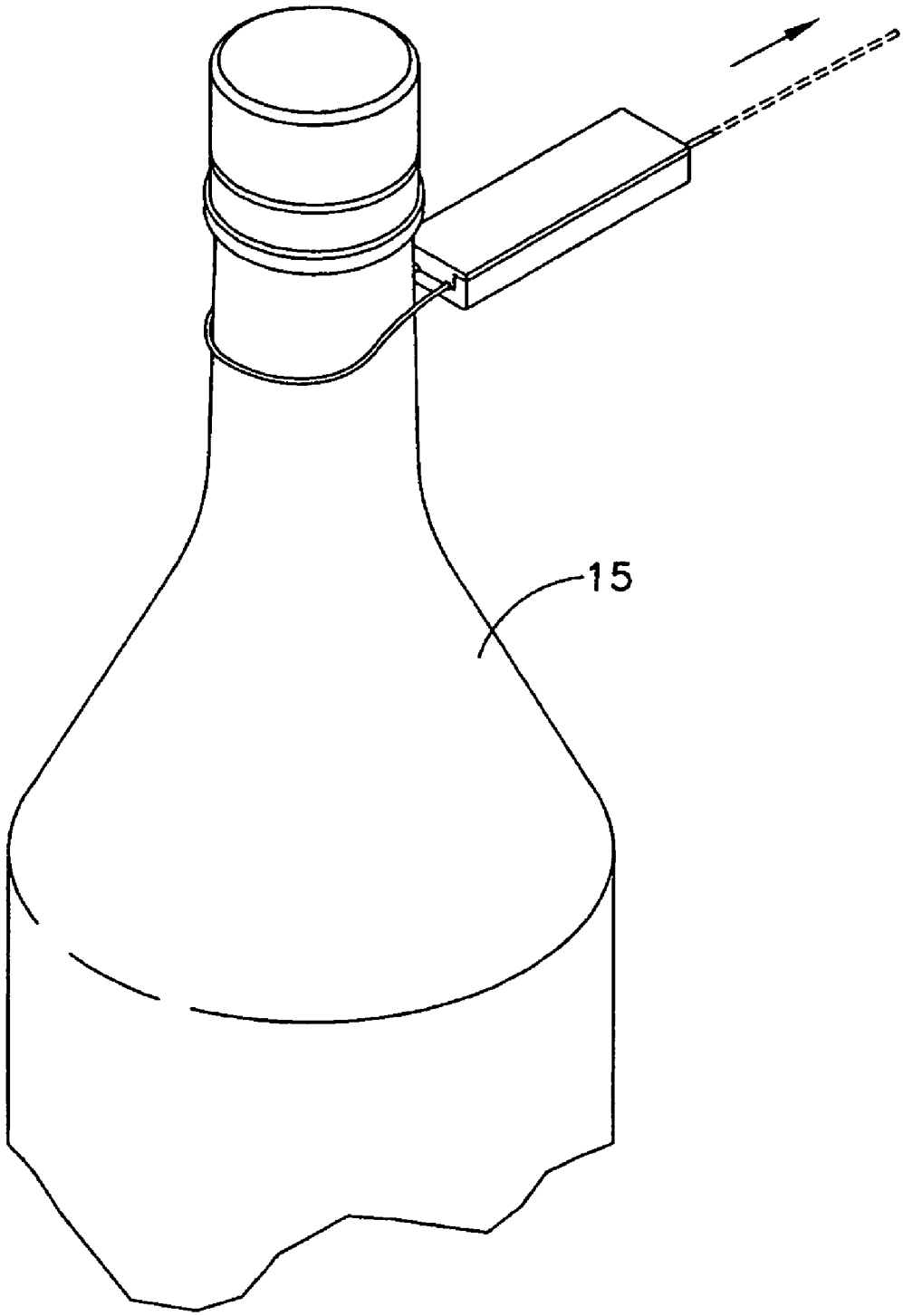
FIG. 23 is a perspective view showing tightening of the anti-theft tag of FIG. 22 to the bottle neck.
Figure 24:
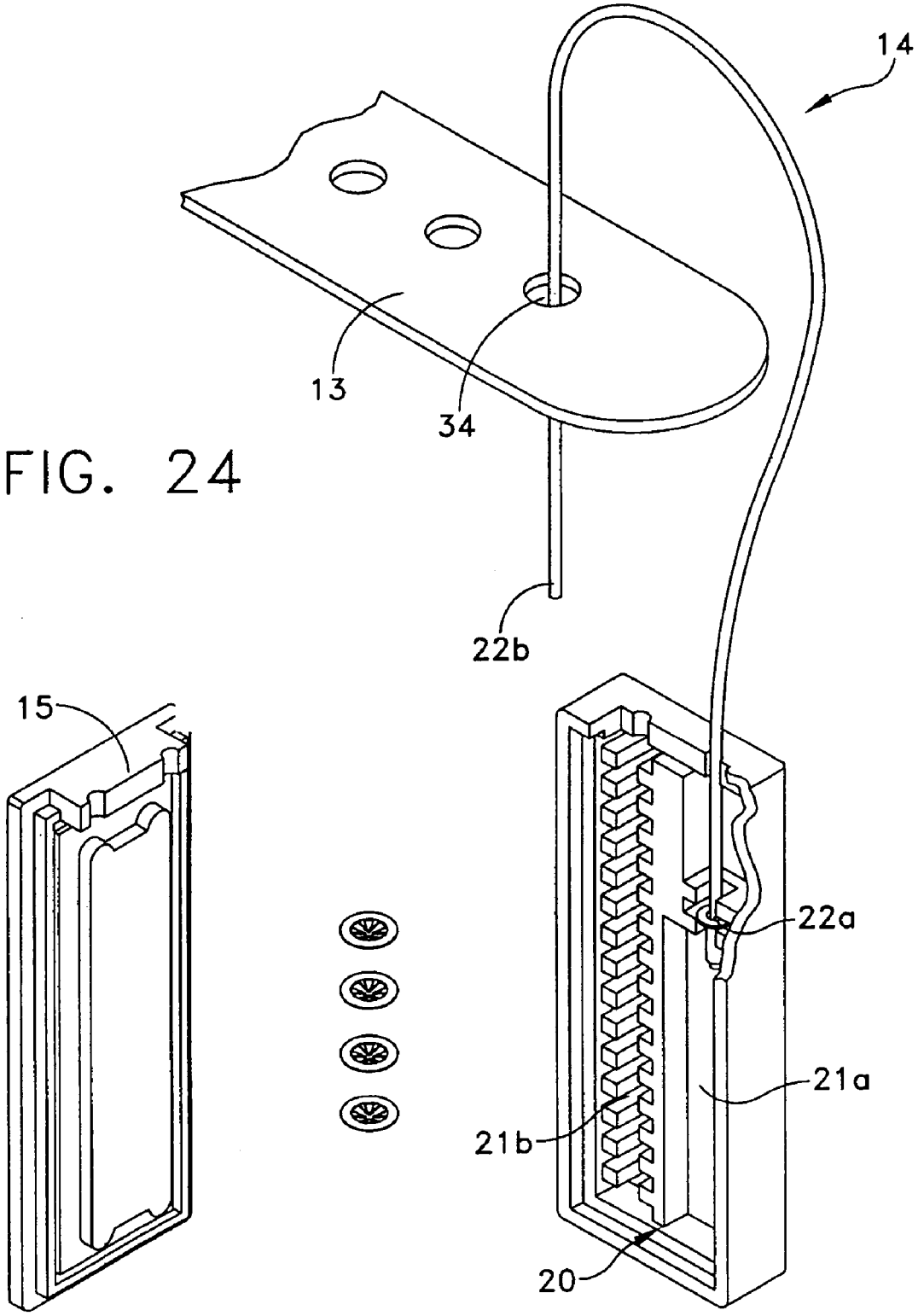
FIG. 24 is a perspective view of an anti-theft tag in accordance with a second embodiment with the housing cover separated from the housing body.
Figure 25:
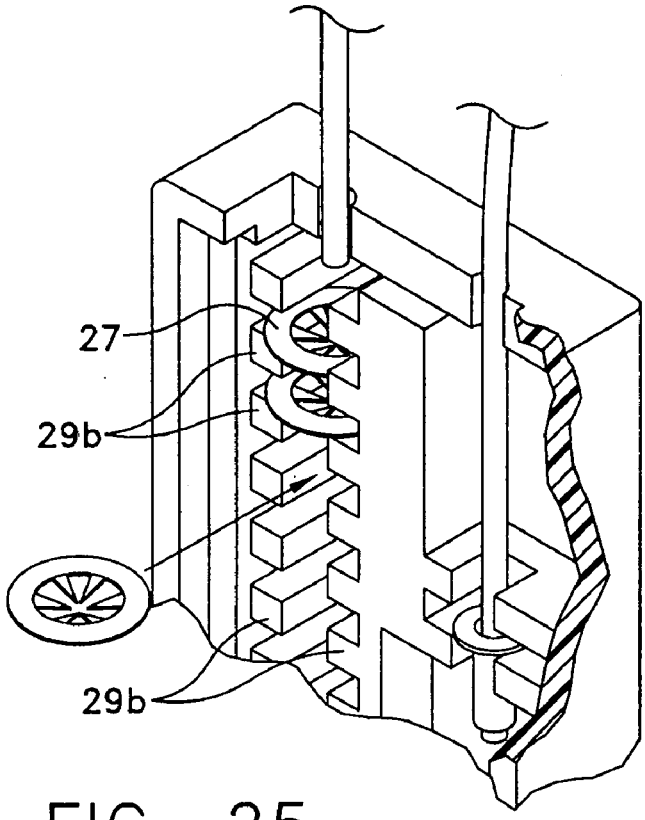
FIG. 25 is an enlarged perspective view of the top section of the housing body of FIG. 15 showing insertion of exemplary crimping members.
Figure 26:
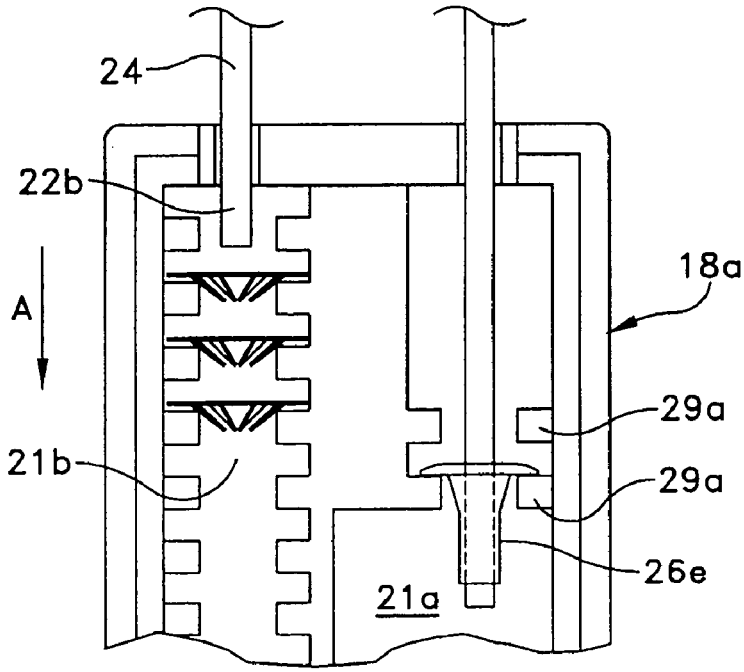
FIG. 26 is a front view of FIG. 25 showing insertion of the free end of the line into the crimping channel.
Figure 27:
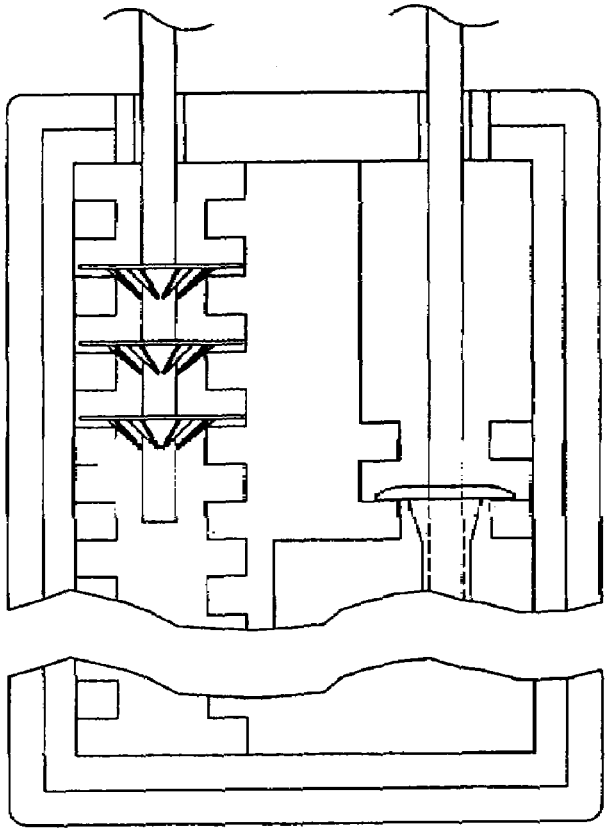
FIG. 27 is a front view of FIG. 25 showing insertion of the free end of the line into the exemplary crimping members.
Figure 28:
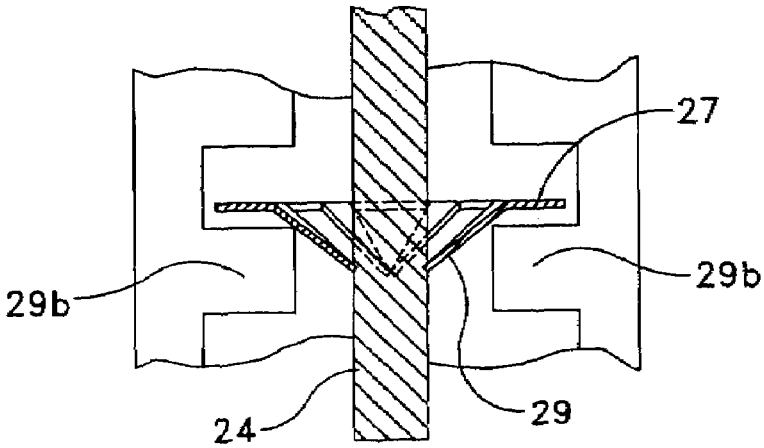
FIG. 28 is an enlarged view of FIG. 27 showing insertion of the line into a single crimping member.
Figure 29:
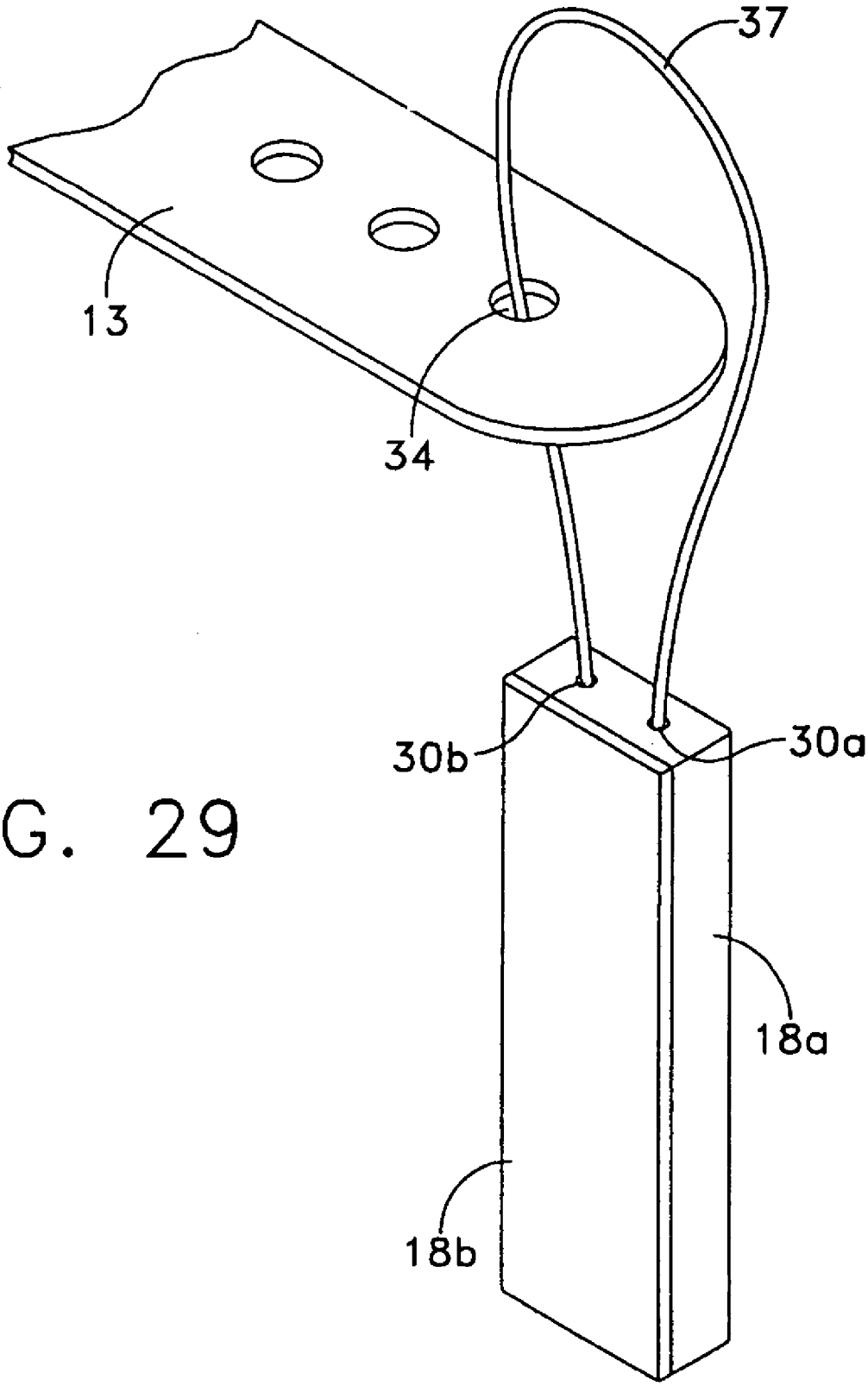
FIG. 29 is a perspective view showing attachment of the anti-theft tag of FIG. 24 to a watch band.

In use, to attach the anti-theft security tag, the first end 22*a* is secured to the housing and the insertion, or second end 22*b* is disposed about the article, for example through a hole 34 in a watch band or around the neck of a bottle, and into opening 30*b* so as to form a loop 37 (FIGS. 21-23). The second end 22*b* is then inserted into channel 21*b* and through center 31 in the at least one crimping member 26*a-d* disposed within channel 21*b* (FIG. 10). Once disposed through the center 31 flexible fingers angle in a downward direction, i.e. toward exit opening 23, and engage the line 24. In the present embodiment, the pointed ends of the fingers engage the line such that the second end 22*b* of the line cannot be moved in the upward direction, toward opening 30*b*, but can only be moved in the opposite, downward direction. The second end 22*b* can pass entirely through the housing and out of opening 23. In this manner, the size of loop 37 is adjustable by increasing the length of the line which exits the housing through opening 23. The line continues to be fed through the opening 40 until loop 37 reaches the desired size. Although the loop 37 can be made continually smaller, it cannot be made larger because the crimping members allow movement of the second end 22*b* in only the downward direction. Once the loop reaches the desired size, the tail end 22*b* may be cut so that it is flush with respect to the bottom 19*d* of the base.

Referring now to FIGS. 24-29, an alternate embodiment of the anti-theft tag 10 is illustrated. This embodiment is identical to the embodiment of FIGS. 1-23, except that the size of the loop is limited by the length of the line 24 that fits within the housing. In particular, exit opening 23 is eliminated such that the second end 22*b* is captured within the housing and does not exit the housing. In this manner, the second end 22*b* is tamper resistant as the consumer can not reach into the housing. The alternate embodiment may be used, for example, when the product to which the anti-theft tag is to be attached is know such that the length of the line 24 can be pre-cut to size during manufacturing. The elimination of opening 23 limits the amount the loop 37 can be adjusted to the length of the housing. Other than the line and hence loop 37 being limited in adjustment, the embodiment of FIGS. 24-29 functions in the same manner as that of FIGS. 1-23. Namely, the loop cannot be made larger once the second end is inserted within the crimping members, because the crimping members allow movement of the second end 22*b* in only the downward direction (i.e., into the housing).

Figure 30:
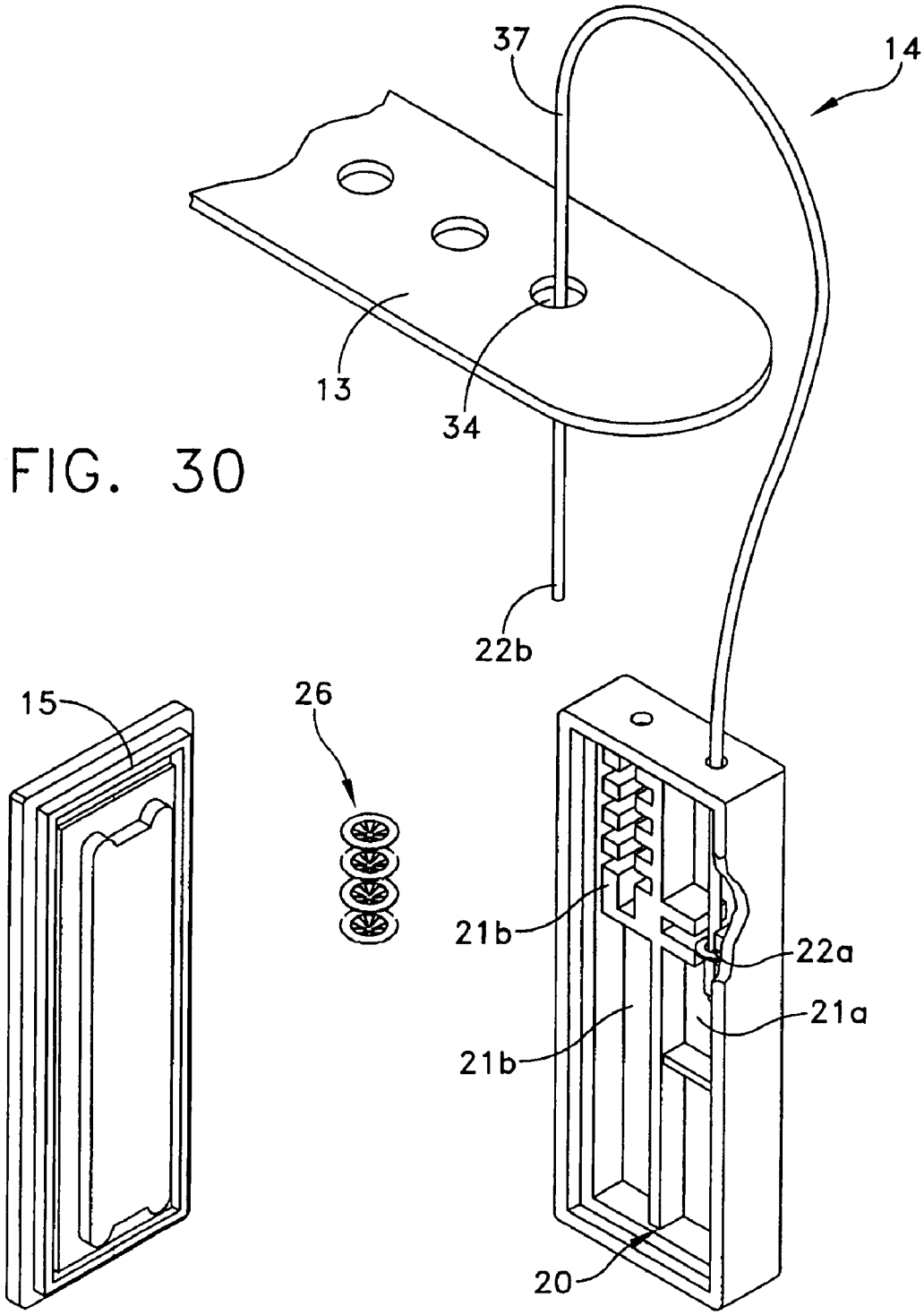
FIG. 30 an exploded view of an anti-theft tag in accordance with a third embodiment.
Figure 31:
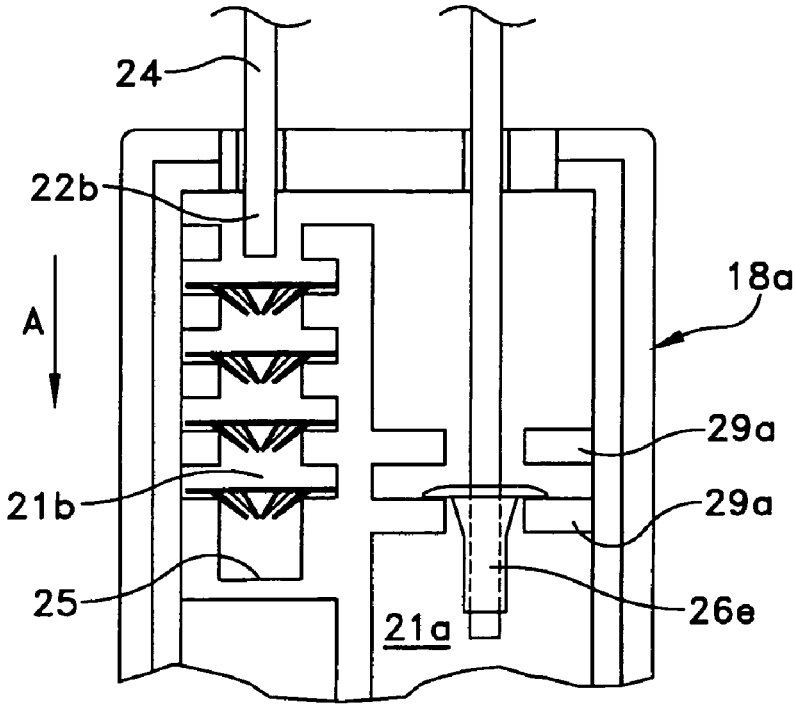
FIG. 31 is a front view of the anti-theft tag of FIG. 30 with cover removed, showing insertion of the free end of the line into the crimping channel.
Figure 32:
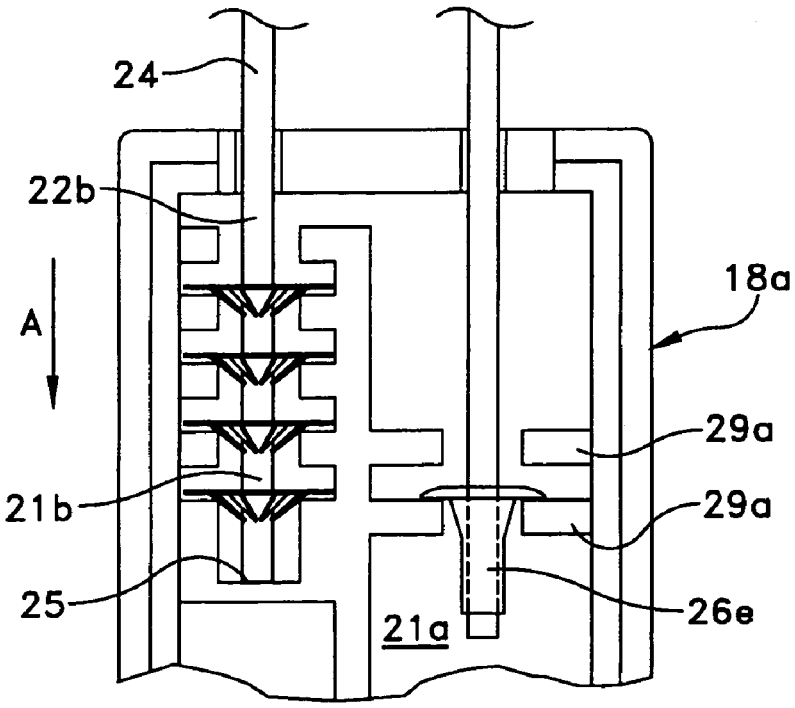
FIG. 32 is a front view of the anti-theft tag of FIG. 30 with cover removed, showing insertion of the free end of the line into the exemplary crimping members.
Figure 33:
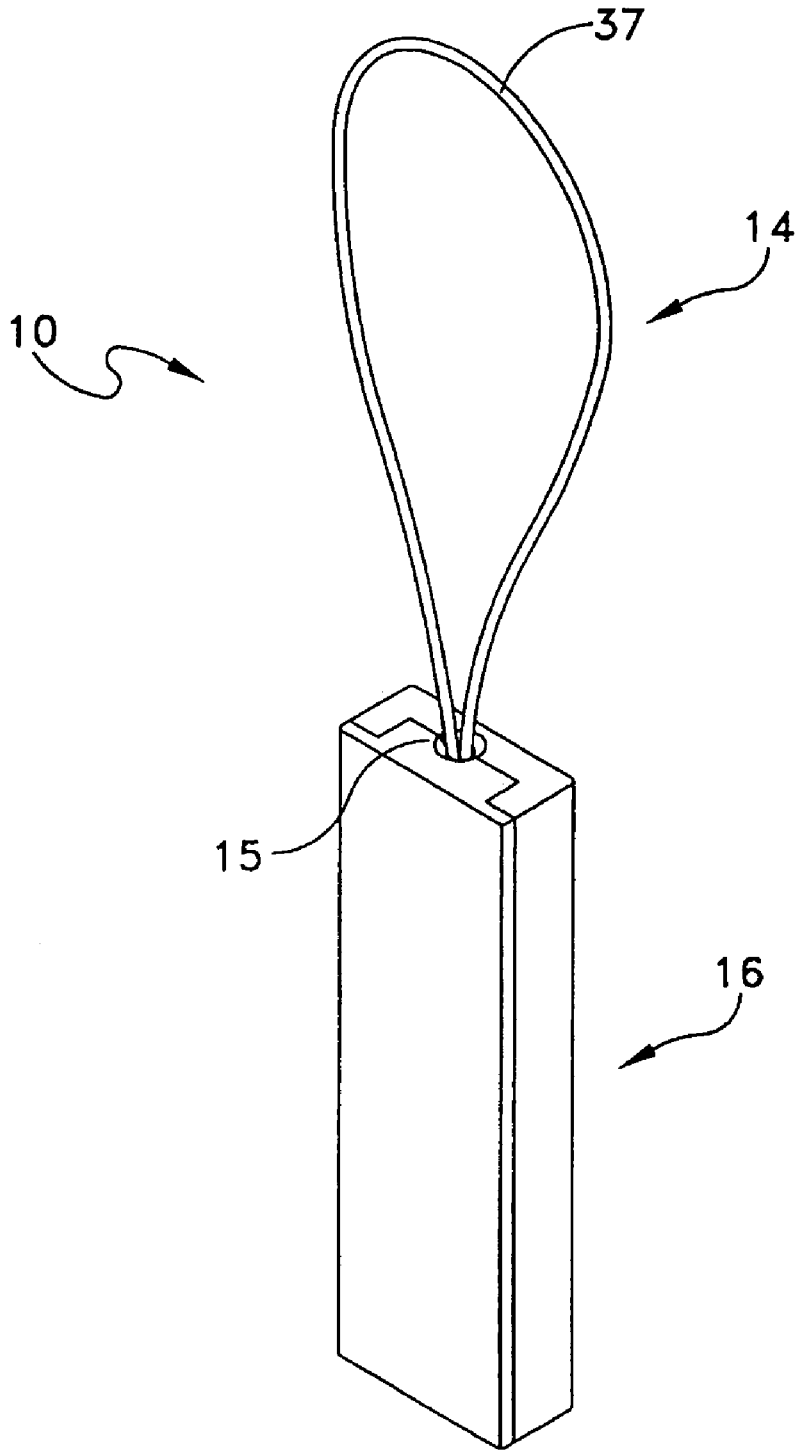
FIG. 33 is a front perspective view of an anti-theft tag in accordance with a fourth embodiment.
Figure 34:
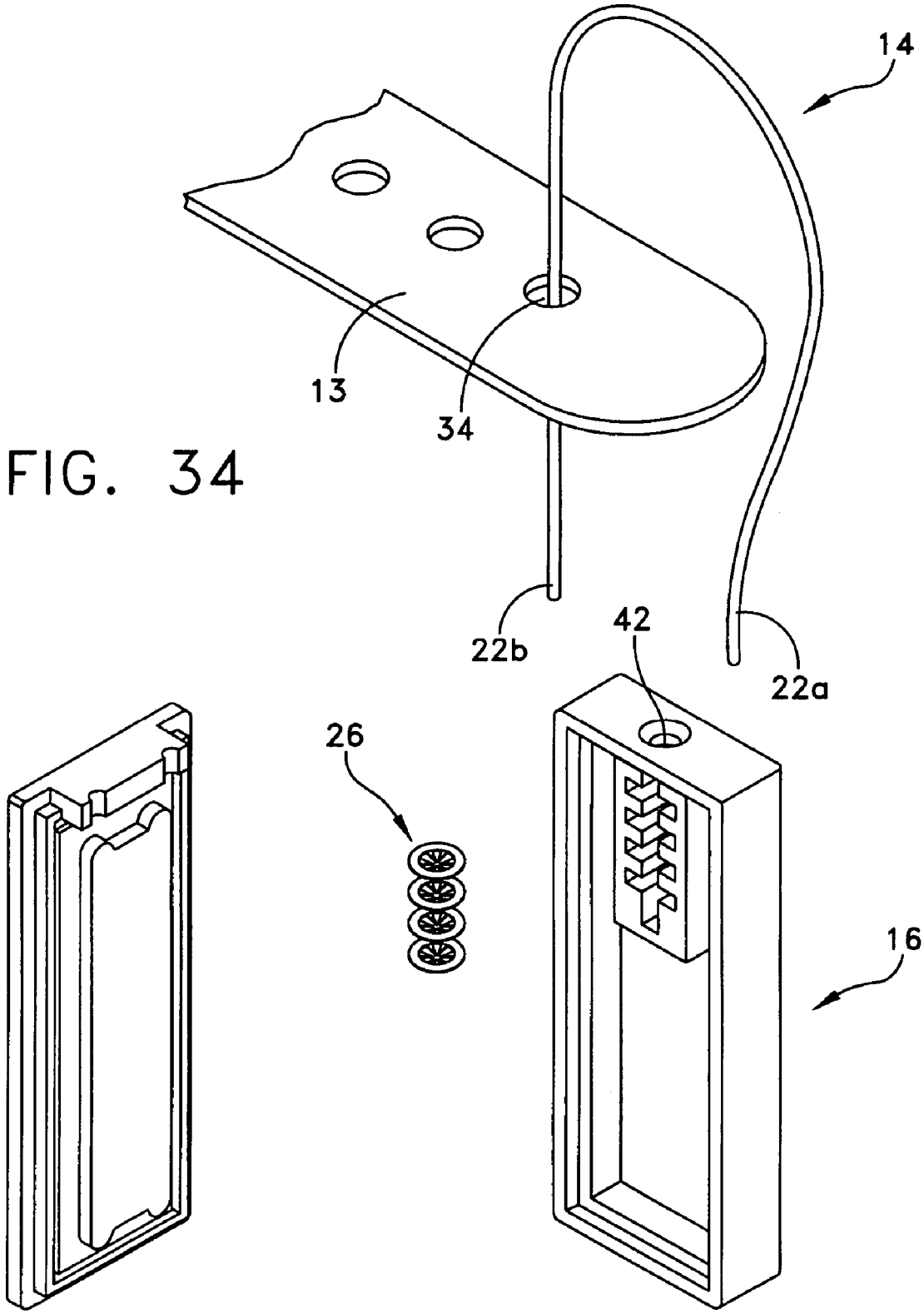
FIG. 34 is an exploded view of the anti-theft tag of FIG. 33.

A third alternate embodiment of the anti-theft tag 10 is illustrated in FIGS. 30-32. This embodiment is identical to the embodiment of FIGS. 24-29, except an interior wall 25 is disposed within channel 21*b* adjacent a lowermost ledge 29*b*. The interior wall 25 acts as a stop to prevent further advancement of the second end 22*b* of the line 24 within channel 21*b*. In this embodiment, the loop 37 which is formed exterior to the housing has a generally fixed size and is not adjustable in an appreciable manner. The size of the loop 37 is determined by the length of line utilized to form the loop and the depth at which the wall 25 is placed within the channel. In the present embodiment, any number of lines of varying lengths may be provided for use with the housing 16, depending upon the particular application. In this manner, the size of the loop is adjustable (by choosing a certain length of line) even if the second end 22*b* of the line is prevented from advancing within the channel 21*b* to effectuate adjustment of the loop 37.

Figure 35:
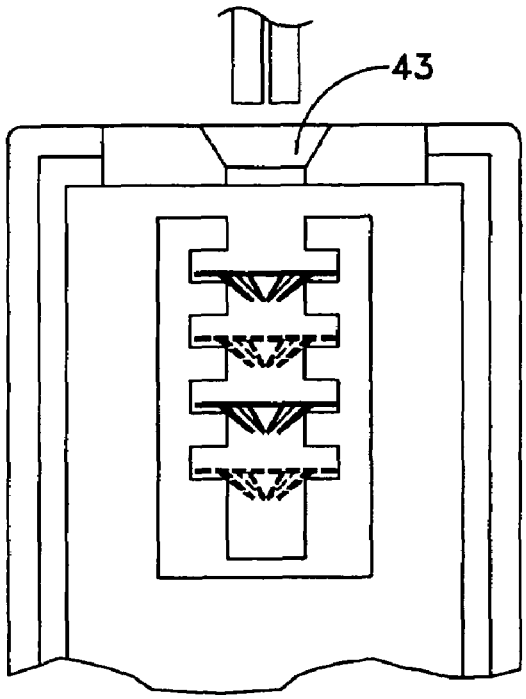
FIG. 35 is a front view of the anti-theft tag of FIG. 33 with cover removed, prior to insertion of the free ends into the crimping channel.
Figure 36:
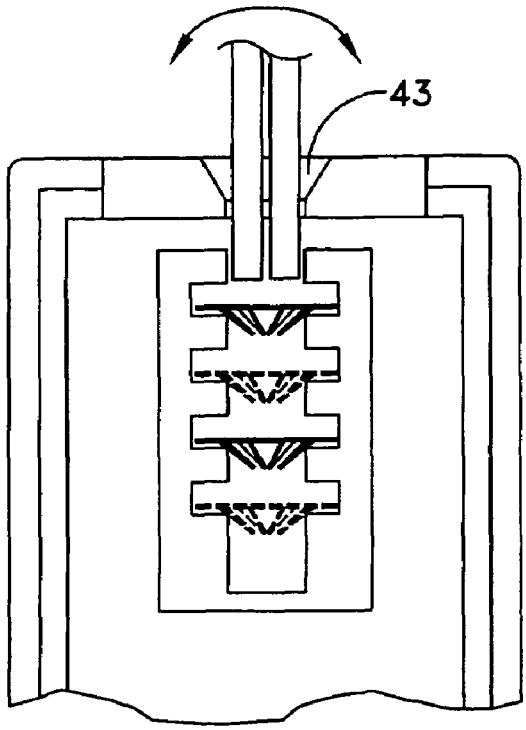
FIG. 36 is a front view of the anti-theft tag of FIG. 33 with cover removed, showing insertion of the free ends into the crimping channel.
Figure 37:
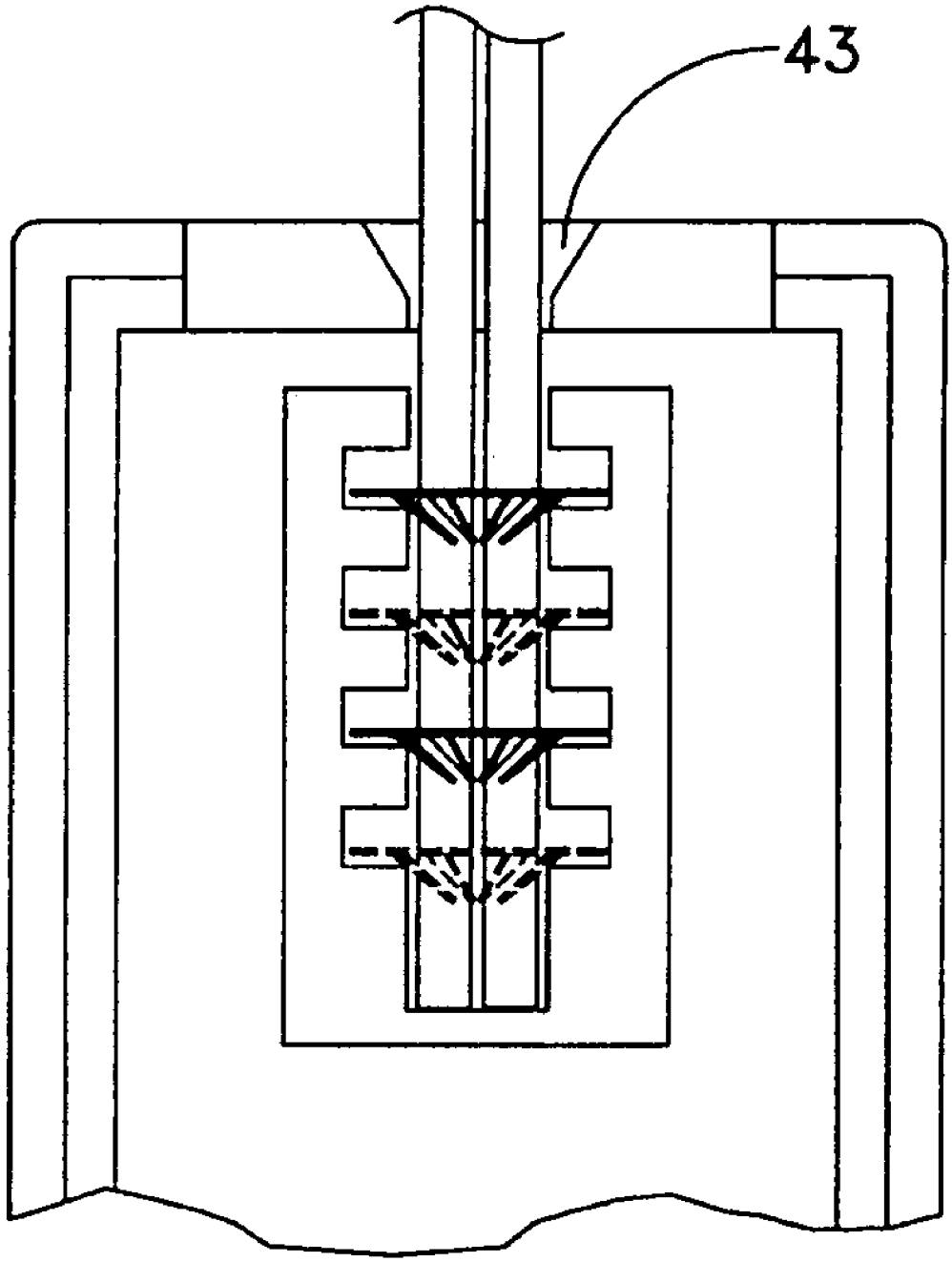
FIG. 37 is a front view of the anti-theft tag of FIG. 33 with cover removed, showing insertion of the free ends into the crimping member.
Figure 38:
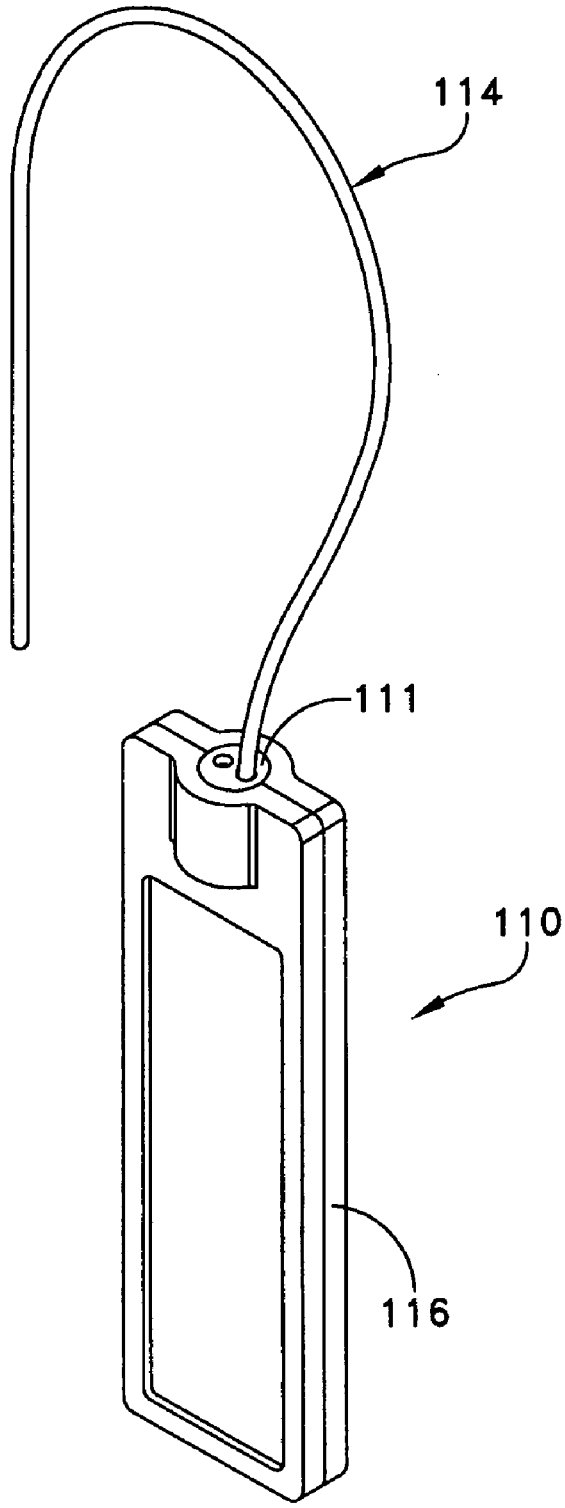
FIG. 38 is a front perspective view of an anti-theft tag with a rotating core in accordance with a fifth embodiment.
Figure 39:
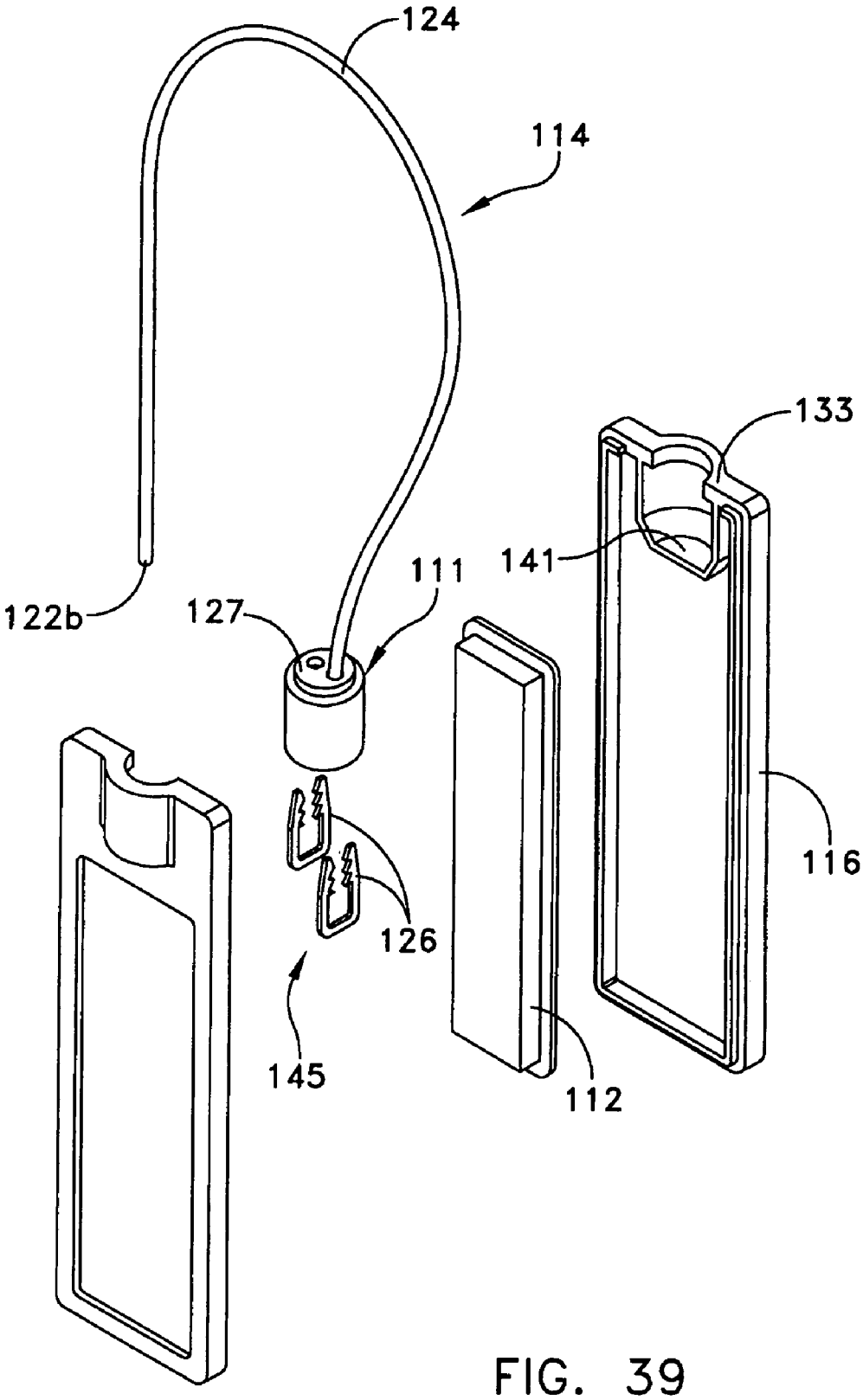
FIG. 39 is an exploded view of the anti-theft tag of FIG. 38.
Figure 40A:
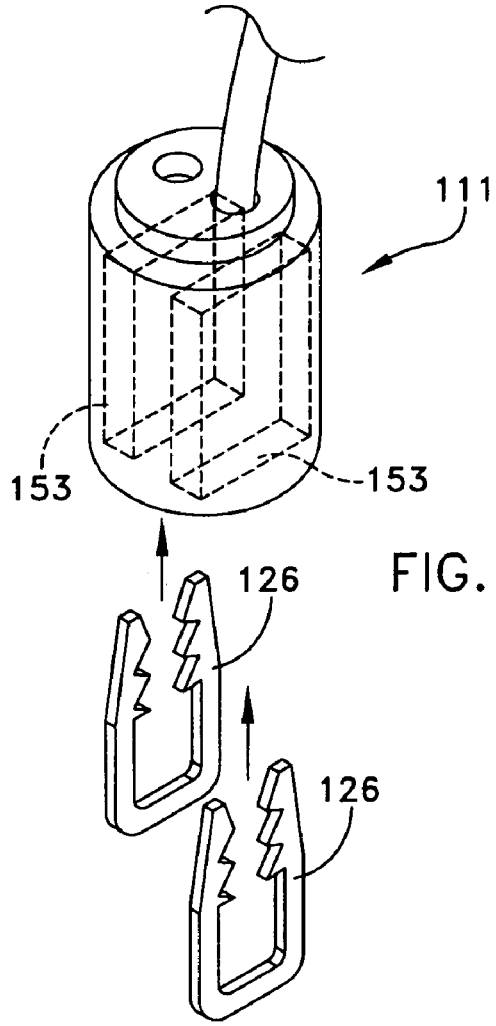
FIG. 40*a* is an enlarged exploded view of the rotating core of the anti-theft tag of FIG. 38.
Figure 40B:
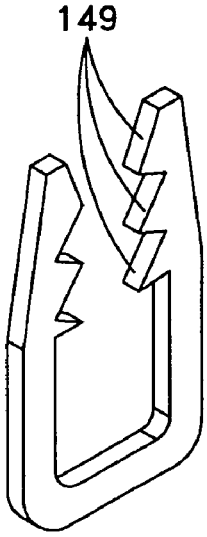
FIG. 40*b* is an enlarged perspective view of the crimping member of the anti-theft tag of FIG. 38.
Figure 40C:
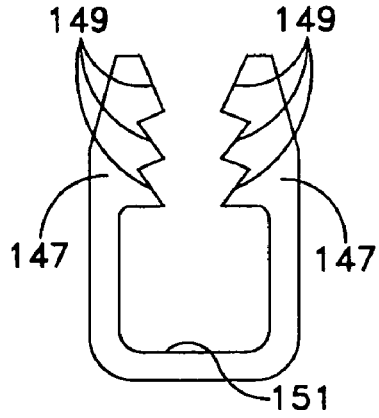
FIG. 40*c* is a front view of the crimping member of FIG. 40*b;*
Figure 41:
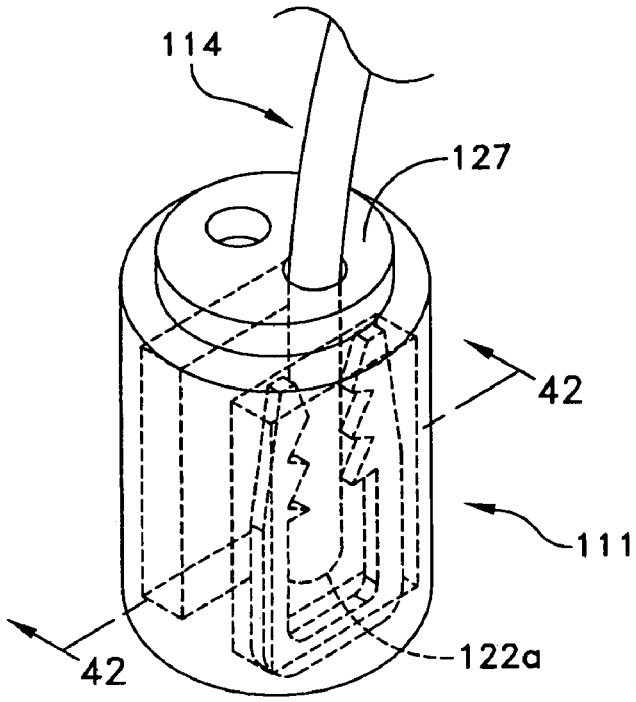
FIG. 41 is an enlarged perspective view of the rotating core of the anti-theft tag of FIG. 38.
Figure 42:
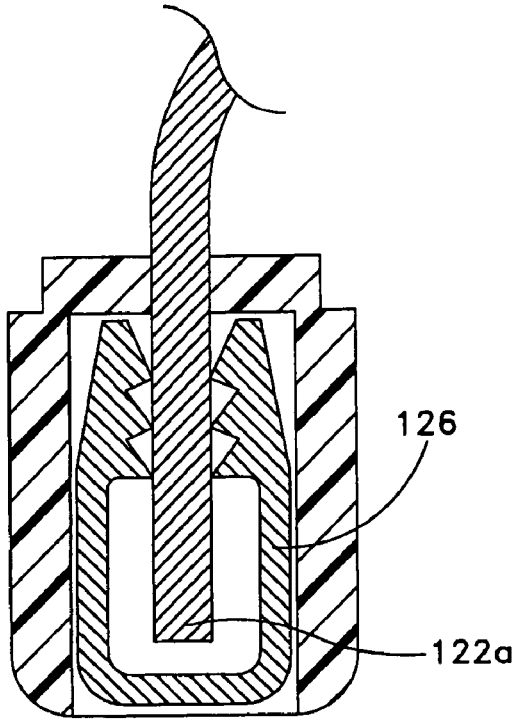
FIG. 42 is a cross-sectional view of the rotating core taken along lines 42-42 of FIG. 41.
Figure 43:
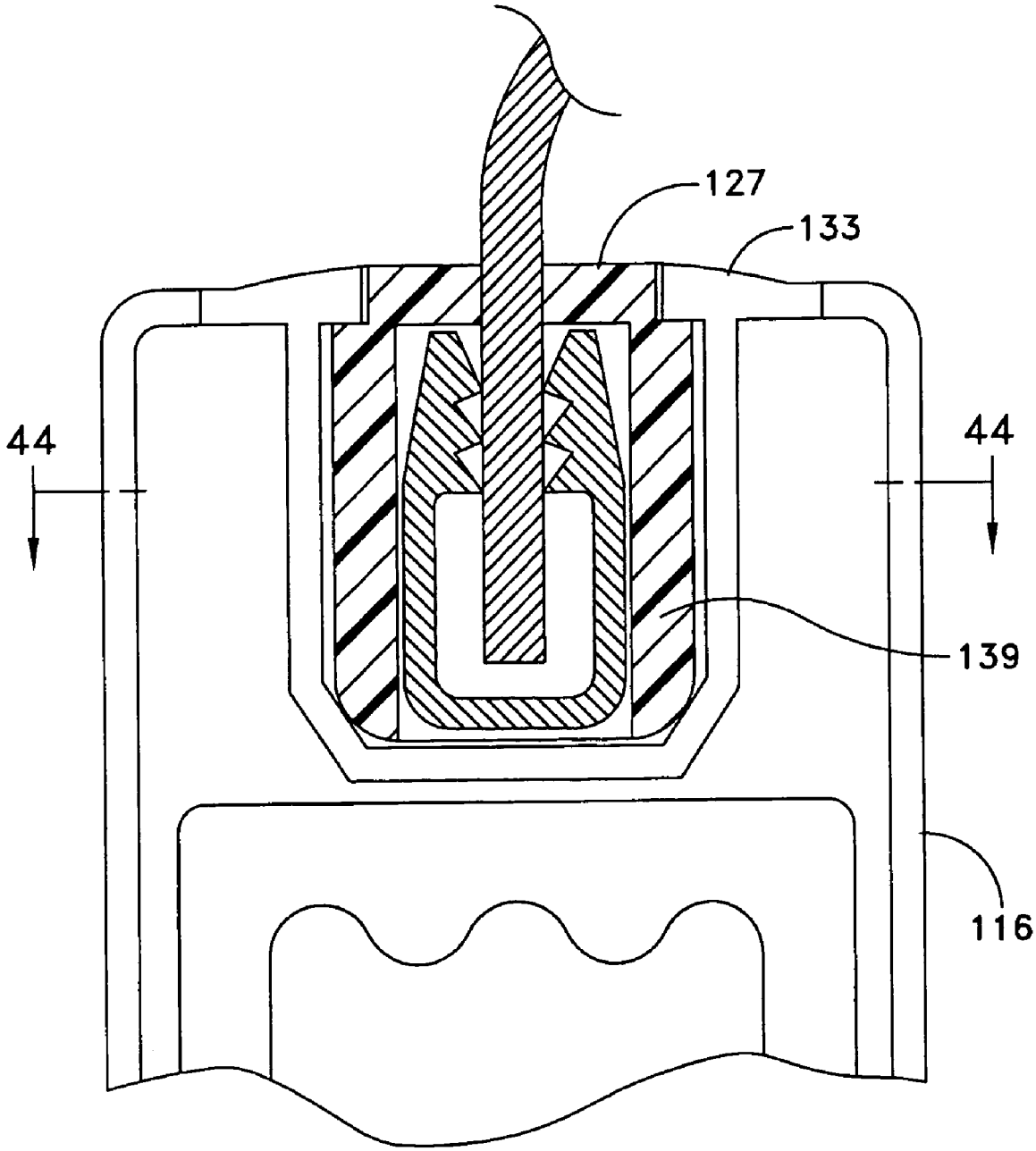
FIG. 43 is a cross sectional view taken of the rotating core of FIG. 38 disposed within the housing.
Figure 44:
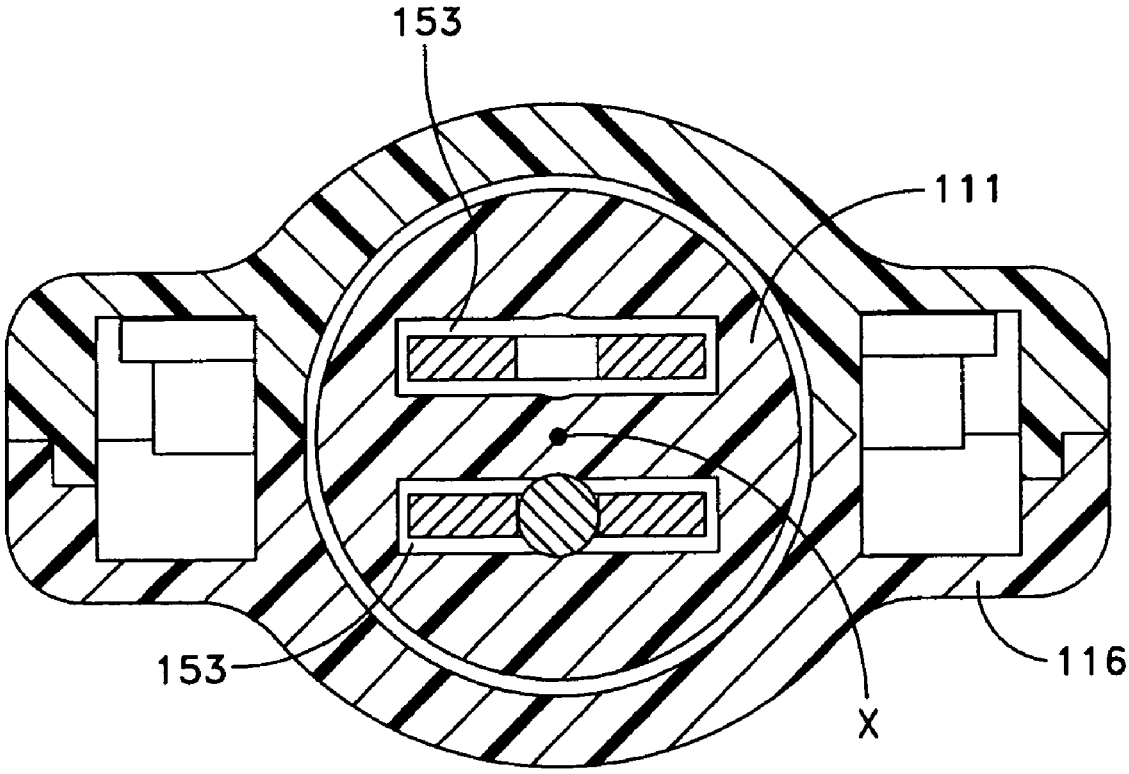
FIG. 44 is a top cross sectional view taken along lines 44-44 of FIG. 43 showing insertion of one line into one of the crimping members.
Figure 45:
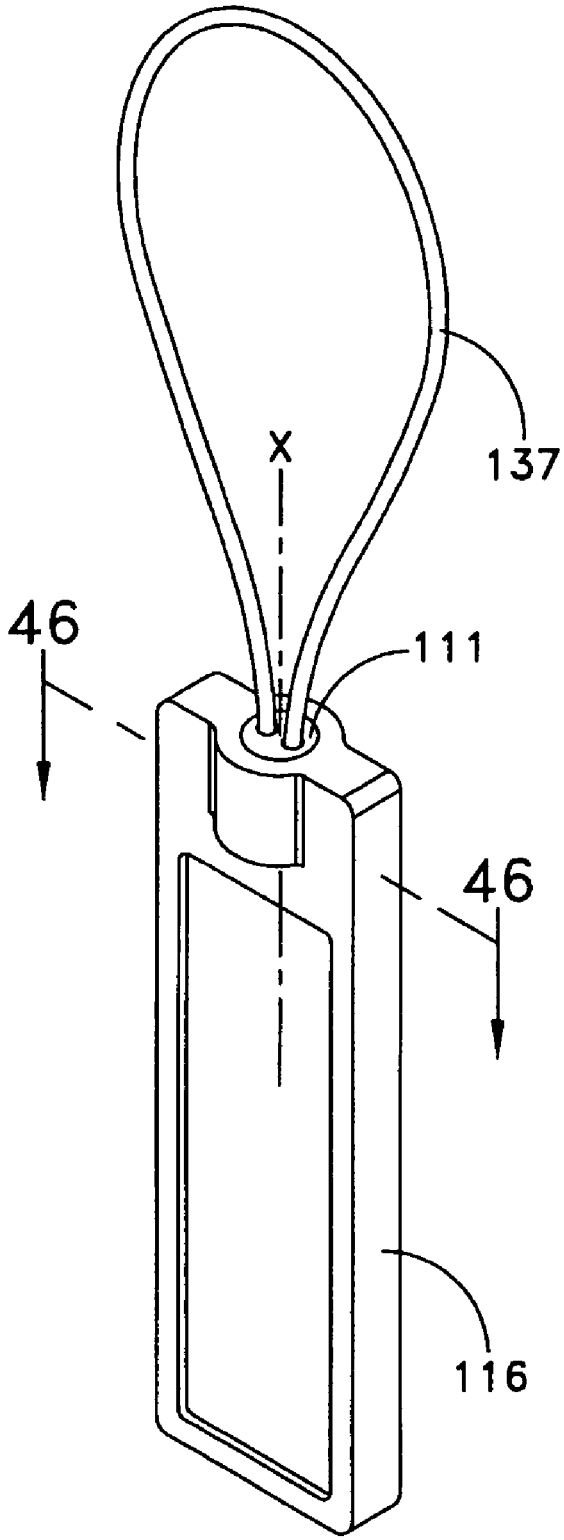
FIG. 45 is a perspective view of the anti-theft tag of FIG. 38 upon insertion of the second end of the engagement member.

Although the first, second and third embodiments illustrate an anti-theft tag in which the first end 22*a* is fixed within the housing 16, it is possible for both the first and second ends 22*a*, 22*b* to be insertable within the housing, for example by a user, and thereafter engaged by a crimping member. For example, both sets of channels 21*a*, 21*b* may be provided with corresponding ledges 29*a*, 29*b* each for supporting one or more crimping members 26. The first and second ends 22*a*, 22*b* could, thereafter be inserted into each of the corresponding channels until engaged by the crimping members. Alternatively, a single channel for receiving both the first and second ends 22*a*, 22*b* could be provided, as shown in a fourth embodiment illustrated in FIGS. 33-37. Again, the fourth embodiment operates in the same manner as the preceding three embodiments, with the exception that the first end 22*a* is not supported within the housing in a fixed manner prior to receipt by a consumer. In particular, the first and second ends 22*a*, 22*b* are separate from the housing until both the first and second ends are inserted within the single channel, 21 that is provided. As best illustrated in FIGS. 35-37, both ends of the line are inserted into a single opening 42, which may include a necked-down or funnel portion 43 that helps to guide both ends into the at least one crimping member 26. In this manner, both the first and the second end are engaged by the fingers of the crimping members in order to secure the engagement member around the article and to the housing 16. A potential advantage to having the both the first and seconds ends supported in this manner is that because the discs 26 are free to rotate in a clockwise or counterclockwise direction as they sit on the ledges, the loop 37 would also be free to rotate relative to the housing. Thus, a consumer would find it harder to apply a twisting force in an effort to break the loop 37 than if one end were fixed and not rotatable (in which case it would be easier to apply a twisting force). Alternatively, the line may also be rotatable by supporting the first and second ends 22*a*, 22*b* within a core member that can rotate relative to the housing.

Referring now to FIGS. 38-47, a fifth embodiment of the anti-theft tag including a core member that is rotatable relative to the housing is illustrated. In this embodiment, all parts which are the same, or similar to, corresponding parts in the previous embodiments are noted with the same last two numerals, but preceded by the numeral "1".

Figure 48:
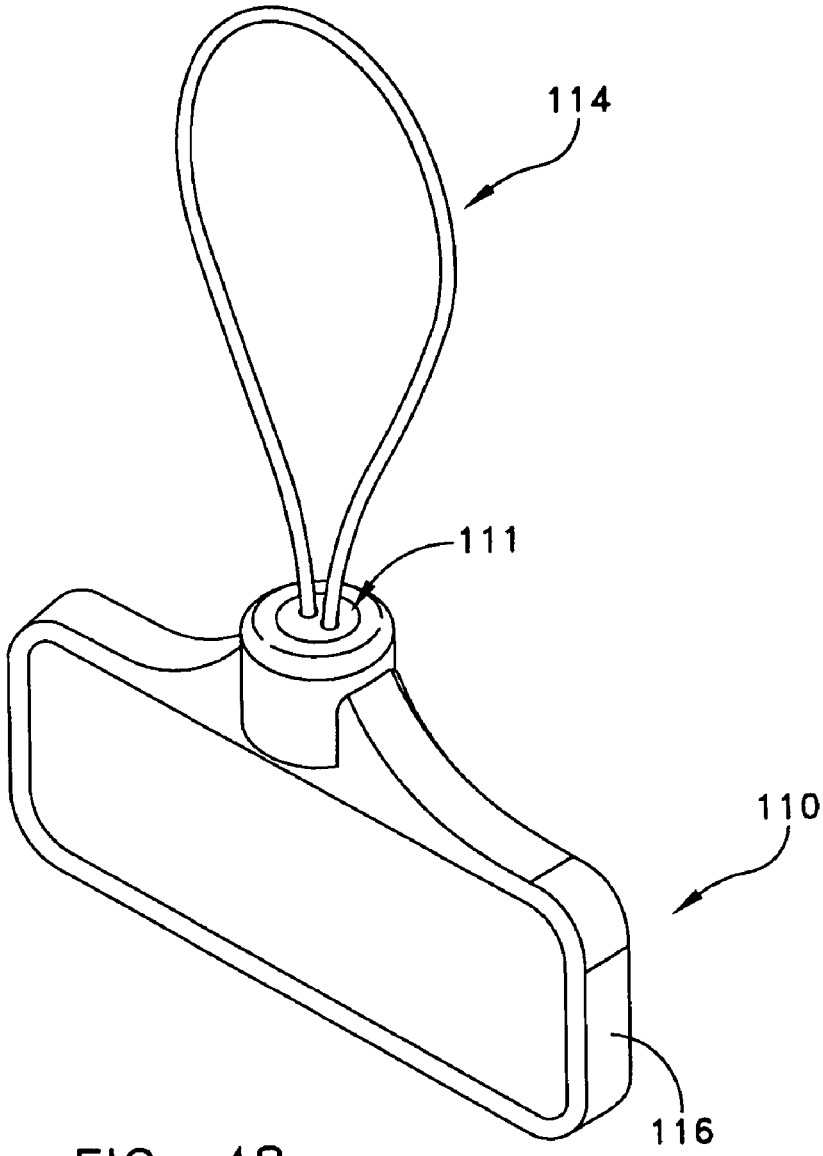
FIG. 48 is a perspective view illustrating an alternate housing in use with the core, crimping members and engagement member of FIG. 38.
Figure 49:
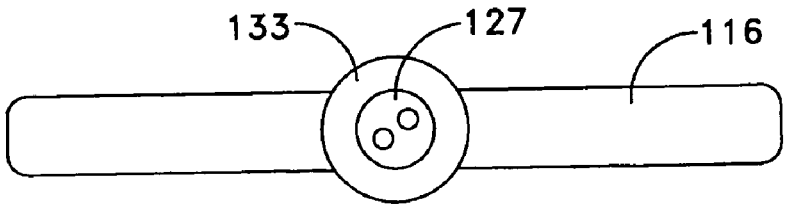
FIG. 49 is a top plan view of the anti-theft tag of FIG. 48.
Figure 50:
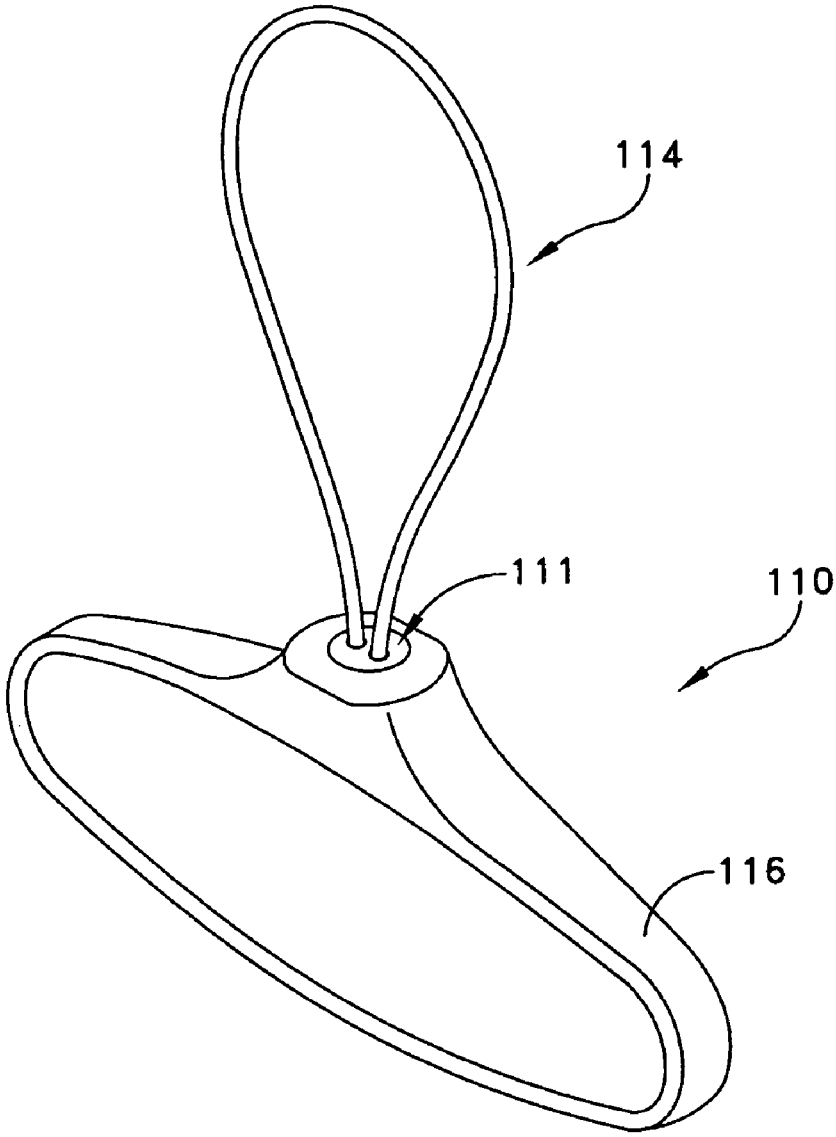
FIG. 50 is a perspective view illustrating an alternate housing in use with the core, crimping members and engagement member of FIG. 38.
Figure 51:
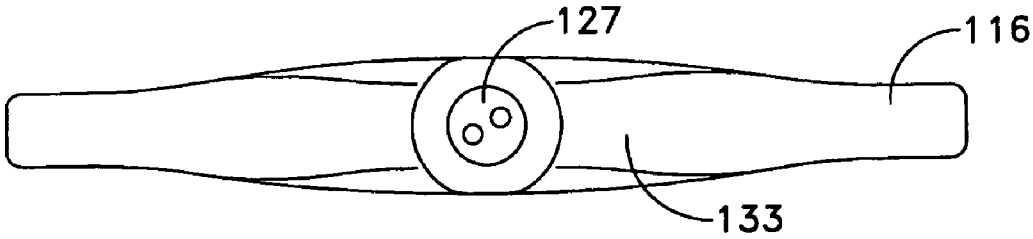
FIG. 51 is a top plan view of the anti-theft tag of FIG. 50.
Figure 52:
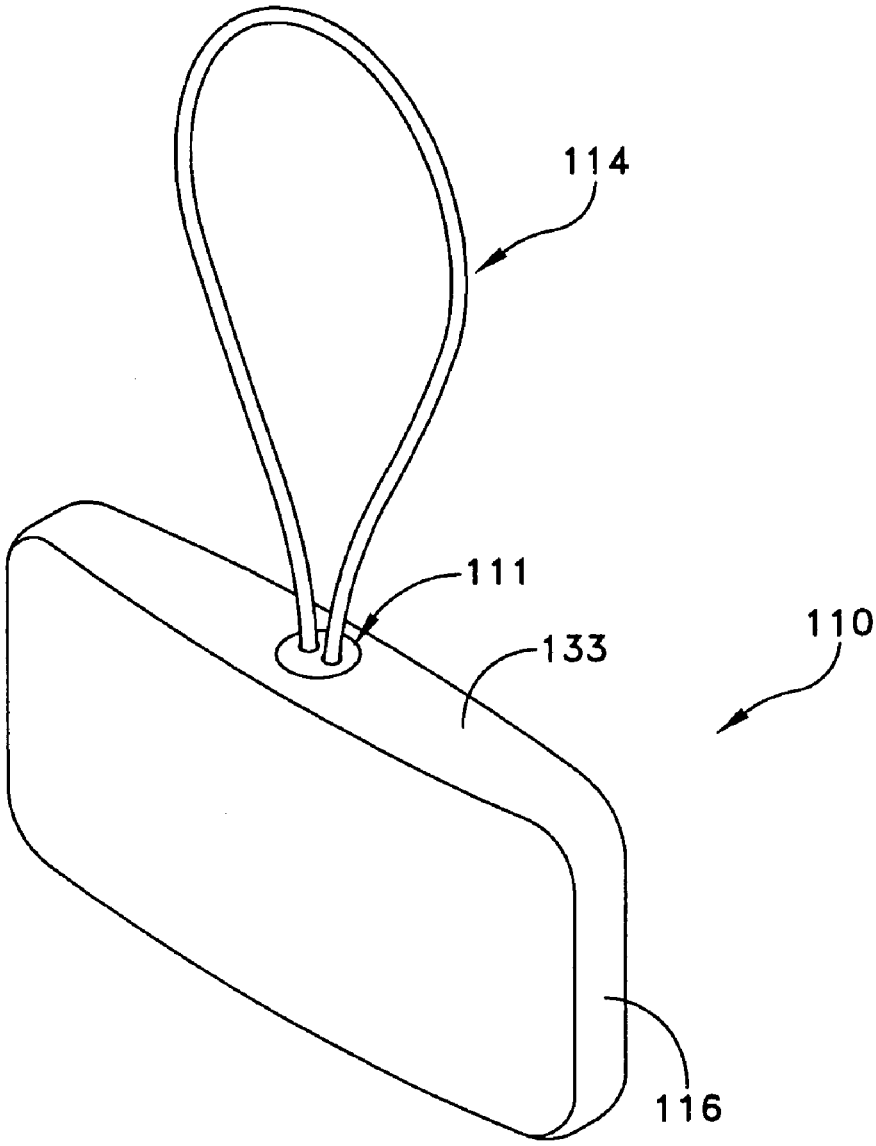
FIG. 52 is a perspective view illustrating an alternate housing in use with the core, crimping members and engagement member of FIG. 38.
Figure 53:
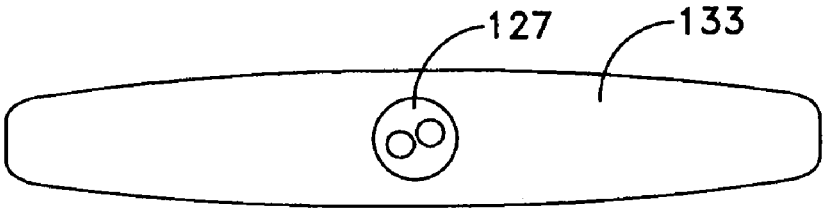
FIG. 53 is a top plan view of the anti-theft tag of FIG. 52.
Figure 54:
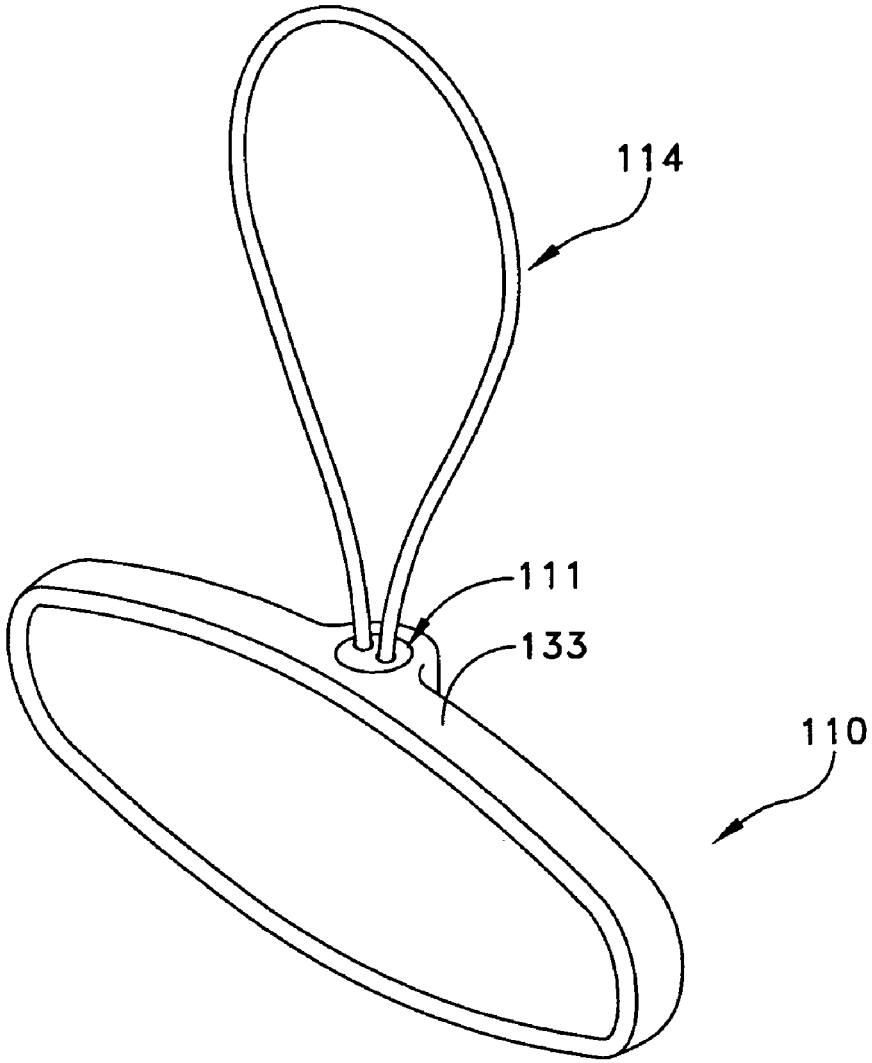
FIG. 54 is a perspective view illustrating an alternate housing in use with the core, crimping members and engagement member of FIG. 38.
Figure 55:
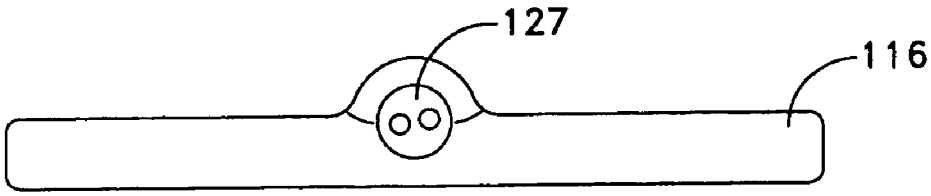
FIG. 55 is a top plan view of the anti-theft tag of FIG. 54.
Figure 56:
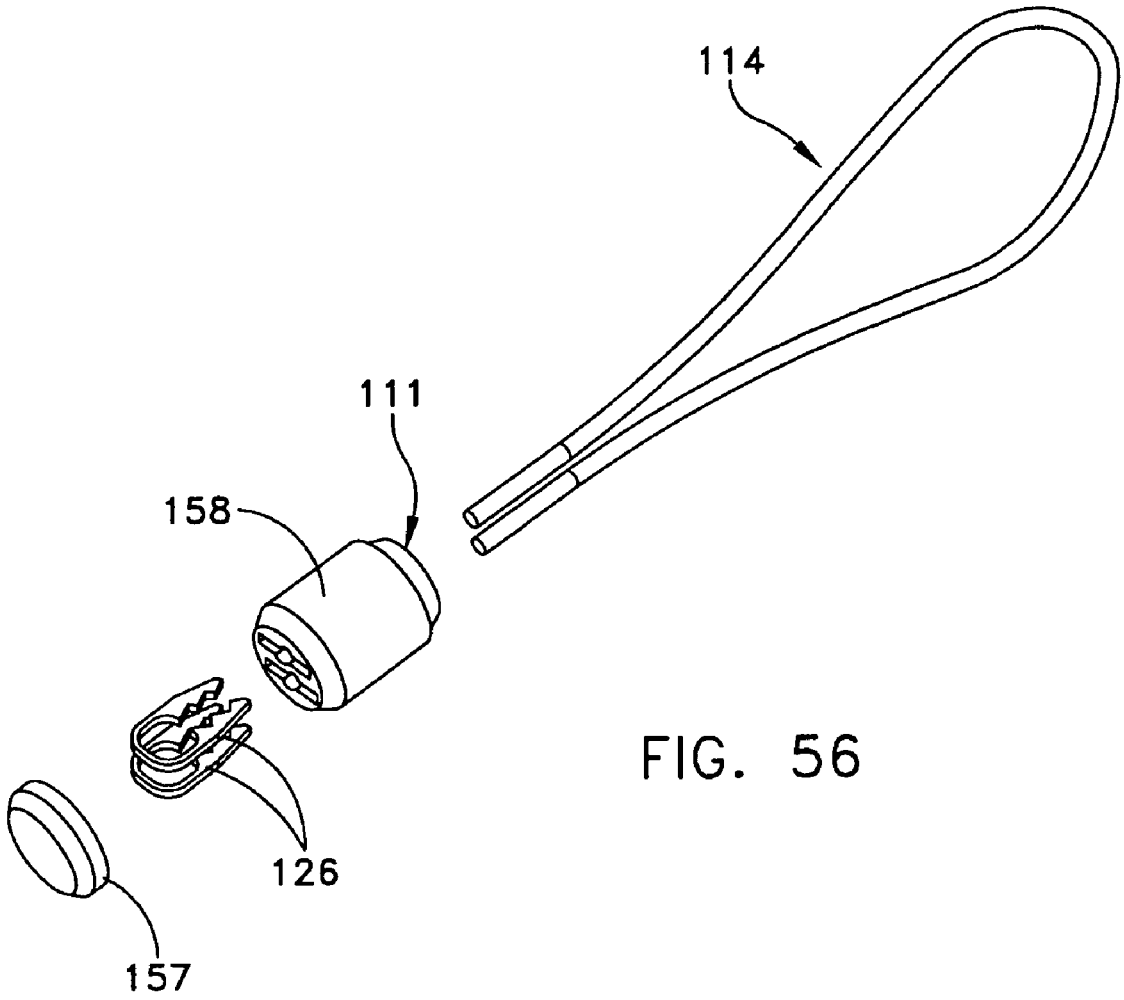
FIG. 56 is a perspective view illustrating an alternate housing in use with the core, crimping members and engagement member of FIG. 38.
Figure 57:
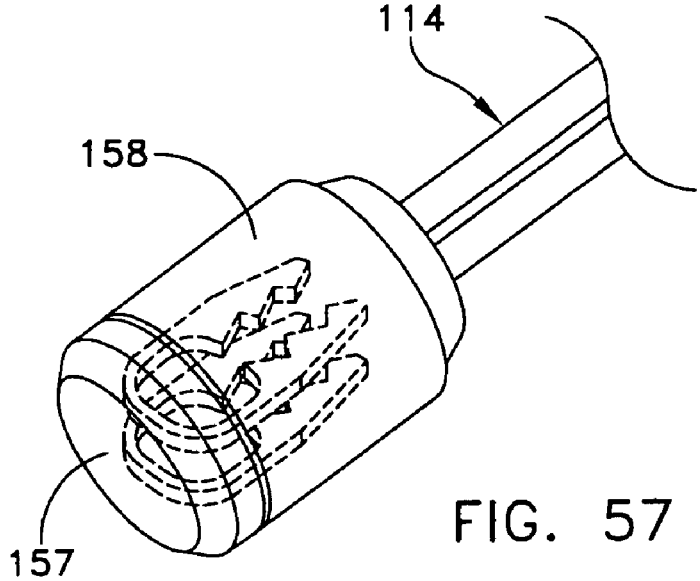
FIG. 57 is an exploded view of the anti-theft tag of FIG. 56.

The anti-theft security tag 110 includes a spinning, or rotating core 111 supported within housing 116 for retaining the engagement member 114 to the article. As described above, the engagement member may include a line 124 for securing to the article and a locking mechanism 145. In the present embodiment, the rotating core 111 preferably includes a first or engagement end 127 which receives both the first end 122*a* and second end 122*b* of the line 124 therein, such that the core and engagement member 114 move together when the core is rotated. The engagement end 127 may be disposed substantially flush with adjacent end 133 of the housing so that the consumer cannot grasp the core in order to break it (FIG. 43), or the engagement end 127 may be raised with respect thereto (see FIG. 48), as desired. The core 111 preferably also includes a body 139 extending from the engagement end 127 and into the interior of the housing 116 such that the body 139 of the core is supported within the housing during use. The housing may have any of a variety of shapes, for example, any of the shapes illustrated in FIGS. 48-55, as well as others as would be known to those of skill in the art, and preferably supports an electronic article surveillance (EAS) marker 112 therein. The housing shapes illustrated in FIGS. 48-55 all incorporate the rotating core 111, as described with respect to the present embodiment. The housing may also have a compact configuration and may or may not include the EAS marker. For example, FIGS. 56-57 illustrate a compact a housing 116 which includes an end cap 157 and a body portion 158. The core rotates within the body portion 158 and supports a locking mechanism which may include crimping members 126, and engagement member 114, as described herein.

Figure 47:
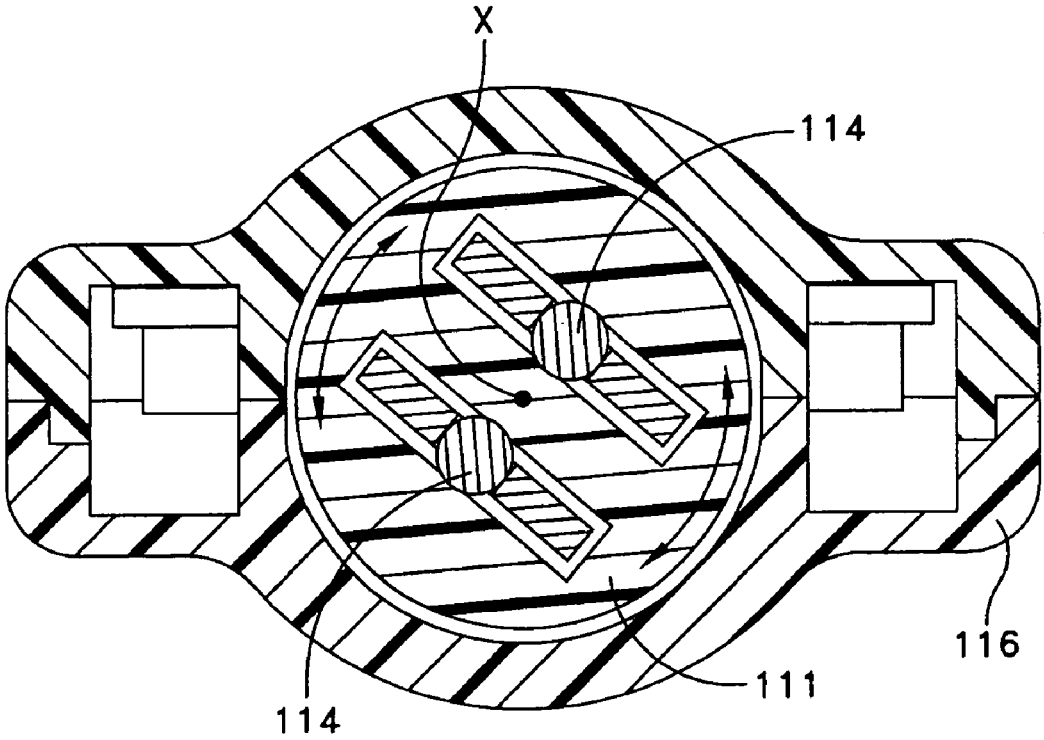
FIG. 47 is a top cross sectional view of an anti-theft tag showing rotation of the inner core, crimping members and engagement member.

As best shown in FIG. 47, the core is supported within the housing so that the core can spin, i.e. is rotatable about an axis "X" (FIG. 45) which extends through approximately the center of the core. A ledge or shoulder 141 may also be provided within the housing for supporting the core for rotation within the housing. Alternatively, other methods of supporting the core for rotation may be provided, as would be known to those of skill in the art. The core may preferably be cylindrical and rotatable at least 180 degrees, and is rotatable 360 degrees in the present embodiment. The engagement member 114 also preferably includes a locking mechanism 145 supported within the core which operates to secure the line 124 within the core during use, such that the core and engagement member rotate together. The locking mechanism 145 may include one or more crimping members 126, the one or more crimping members 126 being self-crimping in the present embodiment such that they automatically secure the line upon insertion there through, as described herein above with respect to the previous embodiments. The self-crimping members allow the line to be moved downward, but not upward, so that the engagement loop preferably cannot be removed from the housing by a consumer so as to be secured in a permanent manner. Alternatively, the locking mechanism need not include crimping members and may be any style locking mechanism, as would be known to those of skill in the art. For example, the locking mechanism may be a pawl/ratchet style, a trap style, or any other style as known to those of skill in the art.

As best shown in FIGS. 40-43, the core 111 may include one or more slots 153 disposed therein, each slot sized to receive and support at least one crimping member 126. In the present embodiment, the crimping members may be U-shaped, including a pair of legs 147 having fingers or teeth 149 which extend inwardly toward the center of the crimping member and which act to automatically crimp the engagement member upon insertion into the crimping member. The self-crimping members allow the line to be moved downward, but not upward, so that the engagement loop 137 preferably cannot be removed from the housing by a consumer. The base 151 of the crimping members provide a stop to prevent over-insertion of the line within the rotating core. In another embodiment, the crimping members may have an alternate configuration, for example, they may be tubular with a plurality of teeth disposed within the interior wall of the tube for crimping the engagement member or disc shaped, or the like, as disclosed herein above. In any embodiment, the locking members are preferably supported within the core, and the line is preferably inserted within the core and terminates therein such that the ends of the line cannot be tampered with and the core and engagement member rotate together.

Figure 46:
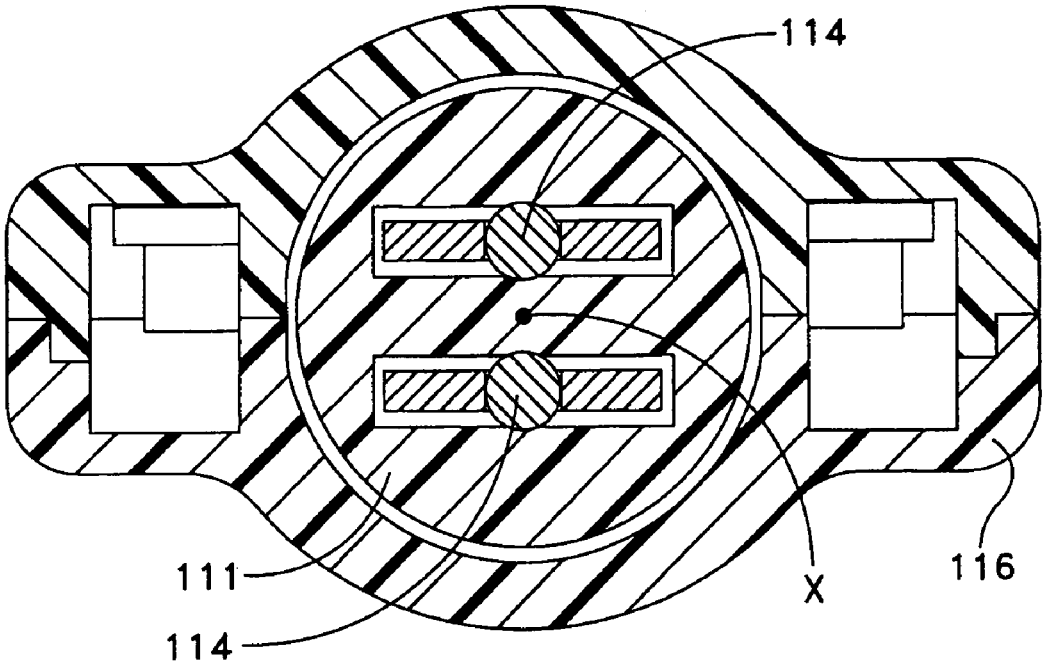
FIG. 46 is a top cross sectional view taken along lines 46-46 of FIG. 45.

Operation of the anti-theft security tag 110 of FIGS. 38-55 will now be described with reference to the figures. In order to attach the anti-theft security tag to an article, the first portion or end 122*a* is secured within the rotatable core, for example by insertion into engagement with crimping member 126*a*, such that the outer surface 152 of the line is engaged and crimped by teeth 149 at a first position on the line. The insertion portion, or second end 122*b* is then disposed about the article, and into opening 130*b* of the core, so as to form a loop 137. The insertion end 122*b* is then inserted into engagement with crimping member 126*a*, such that the outer surface 152 of the line is engaged and crimped by teeth 149 at a second position along the line which is spaced from the first position. The base 151 of the crimping members provide a stop to prevent over-insertion of the line within the rotating core, as described above. Once both ends of the line are secured within the core, the core and the engagement loop are free to rotate in either a clockwise, or counter-clockwise direction from an initial position, as illustrated in FIGS. 46 and 47.

It will be appreciated the anti-theft tags described herein are capable of being readily assembled, while being tamper resistant after assembly, and may be attached to a variety of articles, as desired.

It will be understood that various modifications may be made to the embodiments disclosed herein. For example, the rotating core may have alternate shapes, the crimping members may likewise have alternate shapes than those disclosed, or may be alternate style locking mechanisms, and the line may be formed of alternate materials, for example nylon or other types of plastic. Also, the housing may be any of a variety of shapes, other than those illustrated. Therefore, the above description should not be construed as limiting, but merely as exemplifications of a preferred embodiment. Those skilled in the art will envision other modifications within the scope, spirit and intent of the invention.

What is claimed:

1. An anti-theft tag for attachment to an article, comprising:

a housing;

a line constructed and arranged to secure the tag to the article, the line including a first end and a second end;

a rotatable core including an engagement end and a core body, the body extending from the engagement end and being supported at least partially within the housing, the core being rotatably about a central axis by at least 180 degrees, the core further including at least a first opening and a second opening for receiving the first end and the second end of the line therein;

at least one locking member supported internally within the rotatable core and within the housing, the at least one locking member constructed and arranged to secure the line within the housing upon insertion of the line within the core and into engagement with the locking member; and wherein upon insertion of the line within the core and into engagement with the locking member a loop is formed, and wherein removal of the line from within the core is prevented by engagement of the locking member.

2. The anti-theft tag of claim 1, wherein the size of the loop is adjustable by moving the line in a downward direction further into the core body to decrease the size of the loop, and wherein once engaged with the at least one locking member the second end is unable to move upward, such that the size of the loop may not be increased.

3. The anti-theft tag of claim 1, wherein the line has a continuous outer surface and the locking member is a crimping member constructed and arranged to grip the outer surface of the line.

4. The anti-theft tag of claim 3, wherein the crimping member includes a plurality of teeth, the teeth extending inward toward the line and constructed and arranged to crimp the line upon insertion of the second end into the engagement with the teeth.

5. The anti-theft tag of claim 4, wherein the crimping member is generally U-shaped.

6. The anti-theft tag of claim 1, wherein the rotatable core includes an engagement surface disposed substantially flush with an upper surface of the housing.

7. The anti-theft tag of claim 1, wherein the body of the core is supported on a ledge supported within the housing.

8. The anti-theft tag of claim 1, wherein the housing is sized to support an electronic article surveillance sensor.

9. The anti-theft tag of claim 8, in combination with an electronic article surveillance sensor supported within the housing.

10. The anti-theft tag of claim 1, wherein the core is rotatable about a central axis by 360 degrees.

11. The anti-theft tag of claim 1, wherein the line is selected from the group consisting of coated wire, uncoated wire, nylon, mono-filament line, and plastic.

12. The anti-theft tag of claim 1, wherein the housing includes a cylindrical body and an end cap secured to the housing.

13. The anti-theft tag of claim 1, wherein the outer surface of the line includes an outer layer, the locking member engaging the outer layer during use.

14. An anti-theft tag for attachment to an article, comprising:

a housing including an interior cavity;

a line constructed and arranged to secure the tag to the article, the engagement member having an outer surface, a first end and a second end;

a rotatable core including an engagement end and a core body, the body extending from the engagement end and being supported within the interior cavity of the housing, the engagement end including a first opening and a second opening for receiving a first end and a second end of the line within the body of the core such that the first and second ends of the line terminate within the interior cavity of the housing, the core being rotatably about a central axis by at least 180 degrees;

at least one locking member supported internally within the core body, the at least one locking member constructed and arranged to secure the line within the housing upon insertion of the line within the core and into engagement with the locking member; and wherein the first and second ends of the line are supported internally within the core and form a loop externally of the core, and wherein removal of the line from within the core is prevented by engagement of the locking member.

15. The anti-theft tag of claim 14, wherein the line has a continuous outer surface and the locking member is a crimping member constructed and arranged to grip the outer surface of the line.

16. The anti-theft tag of claim 15, wherein the crimping member includes a plurality of teeth, the teeth extending inward toward the line and constructed and arranged to crimp the line upon insertion of the second end into the engagement with the teeth.

17. The anti-theft tag of claim 16, wherein the crimping member is generally U-shaped.

18. The anti-theft tag of claim 14, wherein the rotatable core includes an engagement surface disposed substantially flush with an upper surface of the housing.

19. The anti-theft tag of claim 14, wherein the body of the core is supported on a ledge supported within the interior cavity of the housing.

20. The anti-theft tag of claim 14, wherein the housing is sized to support an electronic article surveillance sensor.

21. The anti-theft tag of claim 20, in combination with an electronic article surveillance sensor supported within the housing.

22. The anti-theft tag of claim 14, wherein the core is rotatable about a central axis by 360 degrees.

23. The anti-theft tag of claim 14, wherein the housing includes a cylindrical body and an end cap secured to the housing.

24. The anti-theft tag of claim 14, wherein the outer surface of the line includes an outer layer, the locking member engaging the outer layer during use.

25. An anti-theft tag, comprising:

a housing configured to support an electronic article surveillance (EAS) marker; and a rotation member rotatably supported by the housing, the rotation member configured to capture at least a portion of a line to form a loop external to the housing and to secure the anti-theft tag to an article, the rotation member configured to allow rotation of the loop relative to the housing.

26. The anti-theft tag of claim 25, wherein the rotation member comprises a securing member, the securing member being operable to secure at least one of a first end and a second end of the line to the rotation member.

27. The anti-theft tag of claim 25, wherein the rotation member is constructed and arranged to freely rotate about an axis of the rotation member relative to the housing.

28. The anti-theft tag of claim 25, comprising a securing member supported by the housing, the securing member configured to secure at least a first end of the line and allow unidirectional movement of the first end of the line relative to the securing member to form the loop, the securing member configured to allow a loop size of the loop as being decreasable by unidirectional movement of the first end of the line relative to the securing member, the securing member, in cooperation with the rotation member, allowing rotation of the loop relative to the housing.

* * * * *

UNITED STATES PATENT AND TRADEMARK OFFICE

CERTIFICATE OF CORRECTION

PATENT NO. : 7,518,521 B2
APPLICATION NO. : 11/347736
DATED : April 14, 2009
INVENTOR(S) : Jeffrey A. Feibelman et al.

It is certified that error appears in the above-identified patent and that said Letters Patent is hereby corrected as shown below:

Title page, item [75] under Inventors "Jeffrey A Feibelman, Providence, RI (US); Norman Thibaudeau, North Providence, RI (US); William Duarte, Seekonk, MA (US); David Miller, Norton, MA (US)" should read -- Jeffrey A Feibelman, Providence, RI (US); Normand Thibaudeau, North Providence, RI (US); William Duarte, Seekonk, MA (US); David Miller, Norton, MA (US) --

Signed and Sealed this

Nineteenth Day of May, 2009

John Doll

JOHN DOLL
*Acting Director of the United States Patent and Trademark Office*